US007014510B2

(12) United States Patent
Powers et al.

(10) Patent No.: US 7,014,510 B2
(45) Date of Patent: Mar. 21, 2006

(54) WEDGE BASE SEALED LAMP SOCKET

(75) Inventors: Christopher R. Powers, Indianapolis, IN (US); Paul D. Van Duyn, Anderson, IN (US); Carey D. Marks, Anderson, IN (US); David R. McMahan, Noblesville, IN (US); Ismael Garcia, Chicago, IL (US)

(73) Assignee: Guide Corporation, Pendleton, IN (US)

( * ) Notice: Subject to any disclaimer, the term of this patent is extended or adjusted under 35 U.S.C. 154(b) by 171 days.

(21) Appl. No.: 10/264,221

(22) Filed: Oct. 3, 2002

(65) Prior Publication Data

US 2003/0068929 A1 Apr. 10, 2003

Related U.S. Application Data

(60) Provisional application No. 60/326,936, filed on Oct. 4, 2001.

(51) Int. Cl.
*H01R 24/00* (2006.01)

(52) U.S. Cl. ..... 439/699.2

(58) Field of Classification Search ..... 439/918, 439/936, 699.2

See application file for complete search history.

(56) References Cited

U.S. PATENT DOCUMENTS

| | | | | |
|---|---|---|---|---|
| 3,569,907 A | | 3/1971 | Landgraf | |
| 3,936,131 A | | 2/1976 | Durand | |
| 3,950,061 A | | 4/1976 | Kausen | |
| 3,982,813 A | | 9/1976 | Cope et al. | |
| 4,373,771 A | | 2/1983 | Cross et al. | |
| 4,471,414 A | * | 9/1984 | Savage, Jr. | 362/226 |
| 4,573,754 A | | 3/1986 | Hill | |
| 4,664,465 A | | 5/1987 | Johnson et al. | |
| 4,752,710 A | | 6/1988 | Devir et al. | |
| 4,804,343 A | | 2/1989 | Reedy | |
| 4,940,422 A | | 7/1990 | Forish et al. | |
| 4,957,455 A | | 9/1990 | Horiuchi et al. | |
| 5,032,090 A | | 7/1991 | Roy | |
| 5,035,655 A | | 7/1991 | Hesse | |
| 5,082,452 A | | 1/1992 | Takano | |

(Continued)

FOREIGN PATENT DOCUMENTS

EP 0 397 972 11/1990

OTHER PUBLICATIONS

Mercury Tail Lamp Socket Manufactured by Cemm Thome.
Zannx Lamp Socket.
Packard Right Angle and Axial Lamp Sockets.
Toyota Right Angle and Axial Lamp Sockets.
North American Lighting Lamp Socket.
CIC Dually Axial Lamp Socket.
Osram Sylvania Axial Lamp Socket.

*Primary Examiner*—Phuong Dinh
(74) *Attorney, Agent, or Firm*—Ice Miiler

(57) ABSTRACT

The present invention comprises a bulb socket assembly. The bulb socket assembly comprises a bulb accepting body portion, a terminal accepting body portion connected to the bulb accepting body portion, at least one terminal positioned in the bulb socket with the terminal's blade end extending into the bulb accepting body portion and its lead end positioned in the terminal accepting body, at least one wire connected to the lead end of the at least one terminal, and a sealing material substantially covering the lead end and the connected wire of the at least one terminal. One embodiment of the bulb socket assembly further comprises a stabilizing feature that allows the socket assembly to firmly grasp bulbs of various sizes. Another embodiment of the bulb socket assembly further comprises a plurality of alignment features to help guide a bulb into proper alignment with a set of terminals.

27 Claims, 22 Drawing Sheets

U.S. PATENT DOCUMENTS 5,096,427 A 3/1992 Sadigh-Behzadi
5,134,554 A 7/1992 Donato et al.
5,286,223 A 2/1994 Ogawa
5,455,753 A 10/1995 Vollmann et al.
5,466,174 A * 11/1995 Savage, Jr. ..... 439/596
5,536,174 A 7/1996 Forish
5,547,402 A 8/1996 Ogawa
5,558,543 A 9/1996 Takano et al.
5,626,488 A 5/1997 Albeck et al.
5,634,823 A 6/1997 Furuta et al.
5,709,571 A 1/1998 Briski et al.
5,716,240 A 2/1998 Harada
5,727,873 A 3/1998 Tyson
5,731,656 A 3/1998 Greiler et al.
5,795,170 A * 8/1998 Okabe ..... 439/252
5,800,183 A 9/1998 Paul et al.
5,846,100 A 12/1998 Ogawa
5,876,249 A 3/1999 Kim
5,951,318 A 9/1999 Harada
5,971,814 A 10/1999 Boyd et al.
5,989,070 A 11/1999 Al-Turki
6,040,659 A 3/2000 Masuda et al.
6,049,163 A 4/2000 Masuda et al.
6,083,050 A 7/2000 Hsu
6,135,780 A 10/2000 Kelwaski et al.
6,224,428 B1 * 5/2001 Chen et al. ..... 439/694
6,247,829 B1 6/2001 Lee
6,467,942 B1 * 10/2002 Alloway et al. ..... 362/549

* cited by examiner

WEDGE BASE SEALED LAMP SOCKET

CROSS-REFERENCE TO RELATED APPLICATIONS

This application claims the benefit of U.S. Provisional Application No. 60/326,936, filed Oct. 4, 2001.

FIELD OF INVENTION

The present invention relates generally to automotive exterior lighting. Specifically, the present invention relates to light bulb sockets that are used in automotive lamps.

BACKGROUND

Automotive lamps generally employ light bulbs as their light source. These bulbs connect to the rest of the lamp assembly and receive their electrical power through lamp bulb sockets in the lamps. The design of these lamp bulb sockets vary but must at their most basic form contain means to secure the bulb in place in the socket, means to provide the bulb with the electrical power to function, and means to secure the lamp socket to the rest of the lamp assembly. While these are the minimum requirements for a lamp bulb socket, there are numerous other design characteristics that are desirable in modern lamp bulb sockets.

Lamp bulb sockets are typically one of two types. First, "axial" lamp bulb sockets include a housing body that extends directly behind the lamp. The housing body directs the wires connected to the lamp bulb socket away from the lamp bulb socket. In this manner, the wires are placed directly behind the lamp bulb socket and run parallel with an insertion axes 190 (See FIG. 1) along which the lamp is inserted into the lamp bulb socket. Second, "right angle" lamp bulb sockets include a housing body that extends behind the lamp and then at a right angle away from the lamp. The "right angle" housing directs the wires connected to the lamp bulb socket away from the lamp bulb socket at a right angle to insertion axis 190.

The "axial" lamp bulb socket has the disadvantage of taking up a lot of space directly behind an automotive lamp, because the wires, terminals and the seals of the wires to the terminals all take up a great deal of space. A socket that takes up a lot of space directly behind an automotive lamp is undesirable because it limits design options for manufactures and prevents lamp sizes from being further reduced. In contrast, "right angle" lamp bulb sockets does not take up as much space directly behind an automotive lamp because it directs the wires at a ninety degree angle away from the lamp. However, while the right angle socket decreases the need for space directly behind the lamp socket, it increases the diameter space needed around the lamp to house the right angle socket. This too limits design options for automotive manufacturers. These limitations could be avoided with an automotive lamp bulb socket that occupies the same amount of space as a right angle socket directly behind the lamp but at the same time occupies the same amount of diameter space as an axial lamp socket around the lamp.

Another disadvantage with the prior art lamp sockets is that current lamp bulb sockets are manufactured with exteriors that permit either "axial" or "right angle" loading of the lamp bulb socket into the lamp assembly, but not both. As a result, two types of sockets must be produced by suppliers. This creates additional manufacturing expenses. These expenses could be eliminated or minimized by the use of a lamp bulb socket which is designed with an exterior that permits the same socket to be loaded either axially or at a right angle during lamp assembly. Such versatility in the exterior shape of the lamp bulb socket is just one of a number of desirable exterior design characteristics of lamp bulb sockets.

There are a number of additional qualities which are desirable on the exterior of a lamp bulb socket. First, the lamp bulb socket should be designed with exterior features which allow the socket to be easily aligned with the rest of the lamp assembly. This simplifies the process of attaching the lamp bulb socket to the lamp assembly and reduces manufacturing costs. Second, the exterior of the lamp bulb socket should contain a mechanism to securely lock the socket to the rest of the lamp assembly. This prevents the bulb socket from becoming loose inside the lamp assembly which could lead to the malfunction of the light source and the loss of illumination. Third, it is desirable for the exterior of the lamp bulb socket to contain a mechanism to prevent the over-rotation of the lamp bulb socket as it is being attached to the lamp assembly.

There are also qualities which would be desirable in the wiring of the lamp bulb socket. First, the lamp bulb socket should be designed to eliminate the pinching or misalignment of wires during the insertion of a light bulb into the socket. The pinching or misalignment of wires could prevent the proper connection of the bulb with the electrical terminals in the socket leading to a faulty electrical connection. The result is an inoperable light source. Second, the lamp bulb socket should be wired to eliminate as much wire splicing as possible. The elimination of wire splicing is desirable because it decreases the cost of manufacturing by reducing the number of necessary splicing operations, subsequent splice sealing operations, and components needed in constructing an automotive lighting system. Third, the electrical wiring used should be connected to the terminals of the lamp bulb socket by the most efficient method possible. It is also desirable that this connection be environmentally sealed to prevent the elements from degrading the connection and contributing to a premature failure of the light source. An environmental seal located between the lamp bulb socket and the lamp assembly is also required. This seal should be designed to minimize the force required for its installation in order to reduce the cost of manufacture.

In addition to the aforementioned desirable exterior qualities of a lamp bulb socket, the interior of the socket should also be designed with a number of beneficial qualities in mind. For example, the interior of the lamp bulb socket should be designed to help guide the lamp bulb into place. This is desirable for many reasons. First, properly guiding the bulb helps to prevent damage to the bulb's base during the installation of the bulb into the socket. Second, a design which guides the bulb into the proper position decreases the amount of force necessary for the insertion of the bulb, thus, decreasing the cost of manufacturing. Third, properly guiding the bulb into place decreases the possibility of terminal or lead wire damage.

Another design quality that is desirable in lamp bulb sockets is the ability to accept bulbs of varying size. This gives the manufacturer flexibility in the manufacturing process. However, one resulting problem of using differing bulb sizes that is seen in the prior art is the tendency for smaller bulbs to rock or wobble in the lamp bulb socket. Lamp bulb sockets should be designed to incorporate means to eliminate or minimize this wobbling. In addition to means for minimizing the wobbling of the bulb, another desirable feature of lamp bulb sockets is for the bulb to be firmly held in place once the bulb is inserted. The bulb must be secured such that the bulb will not disengage from the lamp bulb socket. If the bulb was not firmly held in place, the proper electrical connection may be lost resulting in a loss of illumination from the light source. Finally, steps should be taken to reduce the mass of the entire lamp bulb socket. Any reduction in the mass of the socket reduces the cost of shipping the final assembled sockets.

Currently, manufacturers produce a number of types of lamp bulb sockets. No design has successfully embodied the above-discussed beneficial qualities. For example, many current sockets continue to have exterior designs which permit only "axial" or "right angle" loading of the lamp bulb socket into the lamp assembly. Additionally, many present sockets employ two-piece terminals which require assembly in the socket. By requiring additional assembly, these two-piece terminals are more likely to be misassembled. Two-piece terminals are also more prone to intermittent continuity problems and additional voltage drop. Thus, a lamp bulb socket employing one-piece terminals would be beneficial.

The lamp bulb socket terminals are usually connected to the power supply by wires which are crimped to the terminals. The terminals are then secured to the body of the socket by a piece called a terminal position assurance. This method of securing terminals requires additional pieces, is time consuming, and requires additional labor. This also increases costs and the rate of faulty connection. Additionally, the crimp method of connecting the wires to the terminals fails to provide a good environmental seal around the connection. As a result, these connections are subjected to the elements and corrode after time. Another disadvantage of most current lamp bulb socket designs is the use of a wiring configuration requiring multiple splices and several wire seals. This configuration adds unnecessarily to the assembly time required and the expense of manufacturing and adversely affects the quality of the harness.

The current methods of stabilizing the bulb known in the prior art are also unacceptable. Rigid bulb support members cannot be used to control the wobble of smaller bulbs and still allow the use of larger bulbs. A separate piece stabilization feature has also been employed by some prior art designs. However, this approach has the shortcomings of increasing part count, manufacturing cost, assembly effort, and the possibility of the component becoming lost. Therefore, it would be desirable to find a new method of stabilizing the bulb.

Thus, a need exists for a lamp bulb socket which provides all of the desirable features discussed above and which solves the related problems in the prior art while remaining relatively inexpensive and relatively simple to assemble.

SUMMARY OF THE INVENTION

The present invention comprises an improved lamp bulb socket design suited for use in automotive lamps with varying bulb sizes. The design incorporates an omni-style external design which allows the lamp bulb socket to be loaded into the lamp assembly either "axially" or at a "right angle." Embodiments of the present invention include lugs which employ locking mechanisms to lock the socket into place and stopping mechanisms to prevent over-rotation during installation. These embodiments of the present invention further utilize one-piece terminals which are connected to the required harness wiring by the crimp method and then sealed by a direct potting method. The direct potting method effectuates an environmental seal around the connection, prevents the connection from corroding and failing, reduces the overall size of the socket assembly, and allows for the socket to be right angle loaded or axially loaded. Additionally, the present invention allows for a plurality of sockets to be daisy chained to one another with the connections still being environmentally sealed. This wiring configuration produces cost savings by reducing the required number of splices.

In addition to all of these external refinements, embodiments of the present invention incorporate a number of internal design improvements. One embodiment utilizes a series of alignment features on the interior of the socket to ease the installation of the bulb and decrease the risk of damage to the bulb during installation. These features include side rail alignment channels, centrally located angular ribs, and an axial channel.

Another embodiment of the present invention comprises a stabilization feature in the interior of the bulb socket that comprises four edge surfaces. These edges are properly spaced so that they allow varying bulb sizes employing either single or multiple filament designs to be used. In conjunction with the tension of the terminals, these edges are able to hold a variety of bulb sizes tightly in place and prevent the bulb from wobbling. The present invention can incorporate all of these features to provide a lamp bulb socket with several beneficial qualities to the automotive industry in a cost-effective manner.

DESCRIPTION

Figure 1:
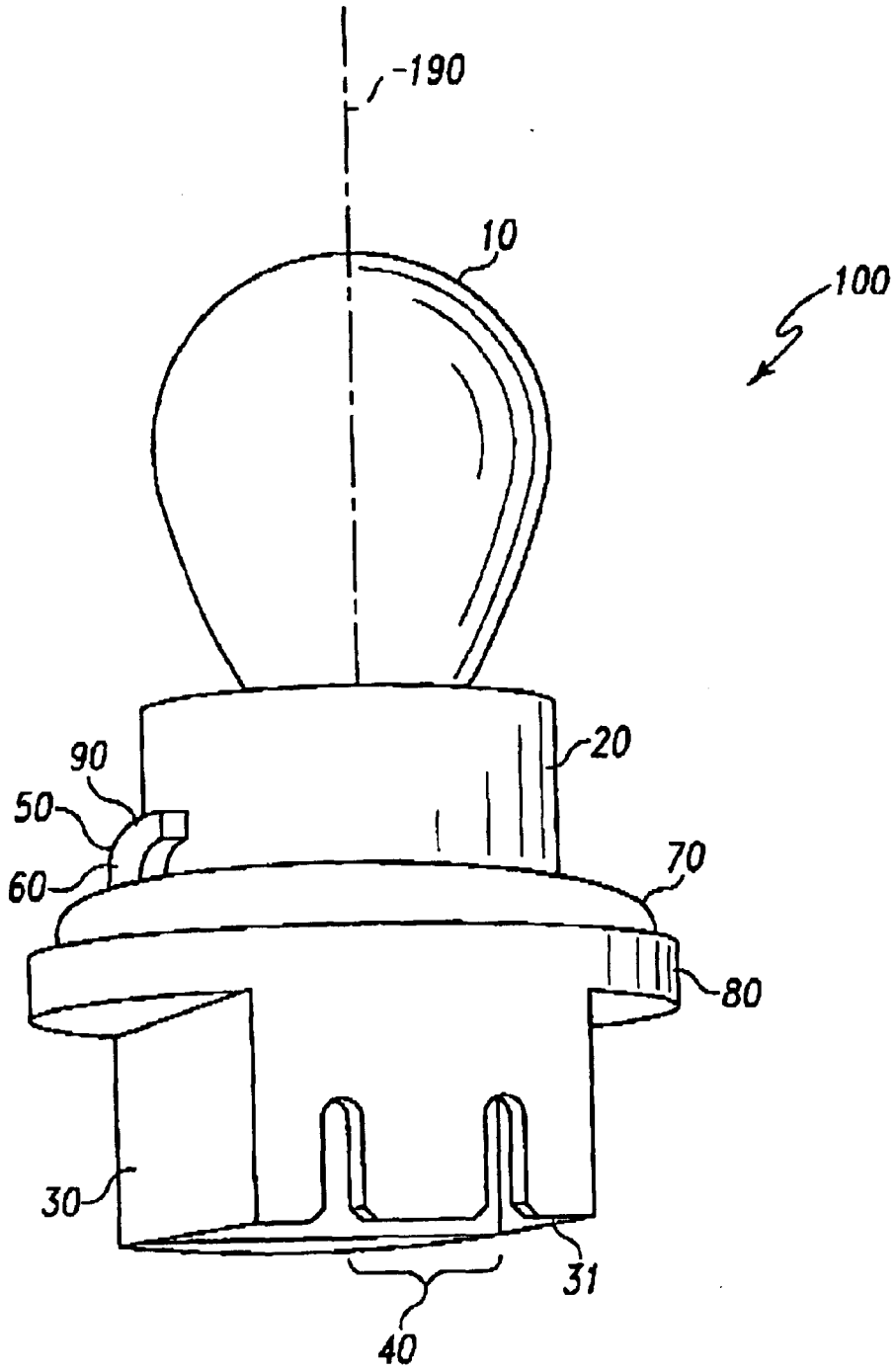
FIG. 1 is a side view of an exemplary W-2 lamp bulb socket of the present invention.

Different embodiments of the present invention relate to an omni-style, wedge base lamp bulb socket assembly that allows for both "axial" and "right angle" loading of the lamp bulb socket into a lamp assembly. Two exemplary embodiments of the present invention are described herein as the W-2 wedge base sealed lamp bulb socket assembly and the W-3 wedge base sealed lamp bulb socket assembly. In FIG. 1, the W-2 embodiment of the present invention is shown fully assembled comprising a bulb 10 and a lamp bulb socket 100. Lamp bulb socket 100 comprises a bulb accepting body 20 connected to a terminal accepting body 30, a plurality of wire retention slots 40, and three lugs 50 (only one pictured) molded onto the side of bulb accepting body 20, a seal gasket 70, and a seal flange 80. While the W-2 embodiment comprises three lugs 50, it will be appreciated by one skilled in the art that no lug, a single lug or any number of a plurality of lugs can be used. Bulb accepting body 20 is preferably integral with terminal accepting body 30 and formed in a common mold. Terminal accepting body 30 includes an outer rim 31 where wire retention slots 40 are formed.

As further shown in FIG. 1, an exemplary embodiment of lug 50 is molded with a stop feature 60 and a lock feature 90. While lug 50 is shown with stop feature 60, not all lugs need to contain the stop feature. The preferred embodiment of the socket 100 does provide for stop feature 60 on at least one lug 50 and, more preferably, at least two lugs will contain lock feature 90 and stop feature 60. In this embodiment, lock feature 90 can comprise a small projection, a bump, or a notch recess and stop feature 60 can comprise a short vertical wall. Stop features and lock features for socket assemblies are well known in the art. Thus, it will be appreciated by one skilled in the art that many equivalent types of lock features and stop features may be used to construct the disclosed embodiment of the present invention.

Figure 2:
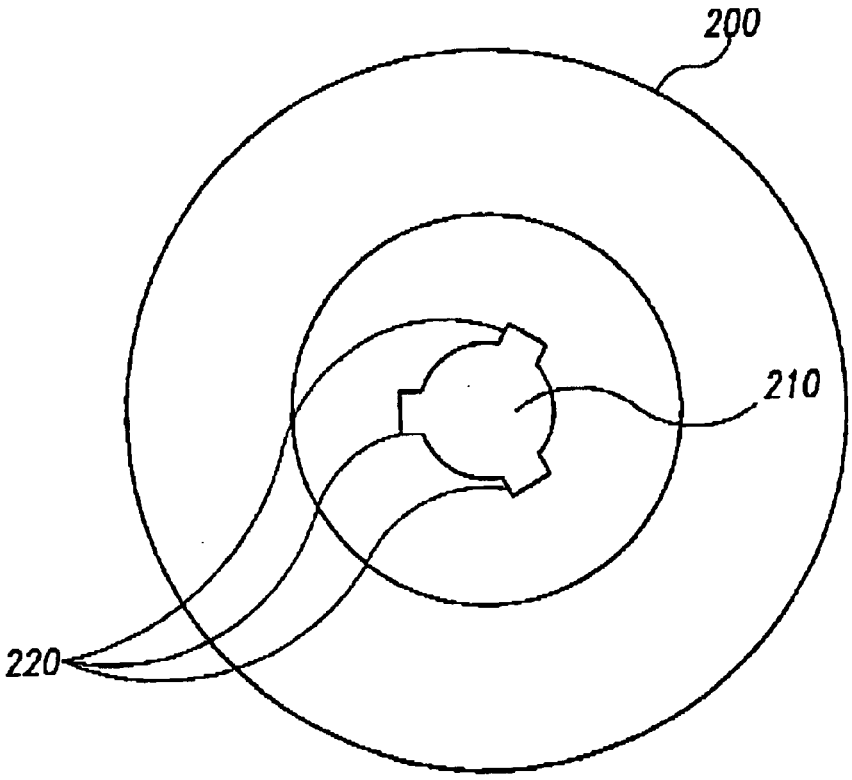
FIG. 2 is a rear view of a lamp housing with a socket recess that can interact with the lamp bulb socket of FIG. 1.

As shown in FIG. 2, a lamp housing 200 utilizes a socket recess 210 with three slots 220. Socket recess 210 is designed to accept W-2 lamp bulb socket 100 with slots 220 designed to interact with lugs 50. While this embodiment depicts socket recess 210 with three slots 220, it will be appreciated by one skilled in the art that socket recess 210 can comprise a single slot or any number of a plurality of slots, so long as the number of slots corresponds to the number of lugs 50 on socket 100. During installation, lamp bulb socket 100 is inserted into socket recess 210, so that lugs 50 are inserted into slots 220 and seal flange 80 covers socket recess 210. Once inserted, lamp bulb socket 100 is rotated so that lock feature 90 slides over a protrusion (not shown) that is located on the side of the interior of socket recess 210 between slots 230. Once lock feature 90 slides over this protrusion, it is prevented from being slid back over the protrusion. In this manner, lock feature 90 interacts with the protrusion of socket recess 210 to provide a reverse rotation lock that retains lamp bulb socket 100 in its installed position. Further, lamp socket 100 is rotated until at least one stop feature 60 abuts against an edge of one of the slots 220. In this manner, stop feature 60 interacts with slot 220 to prevent lamp bulb socket 100 from being over-rotated during the assembly process.

Figure 3A:
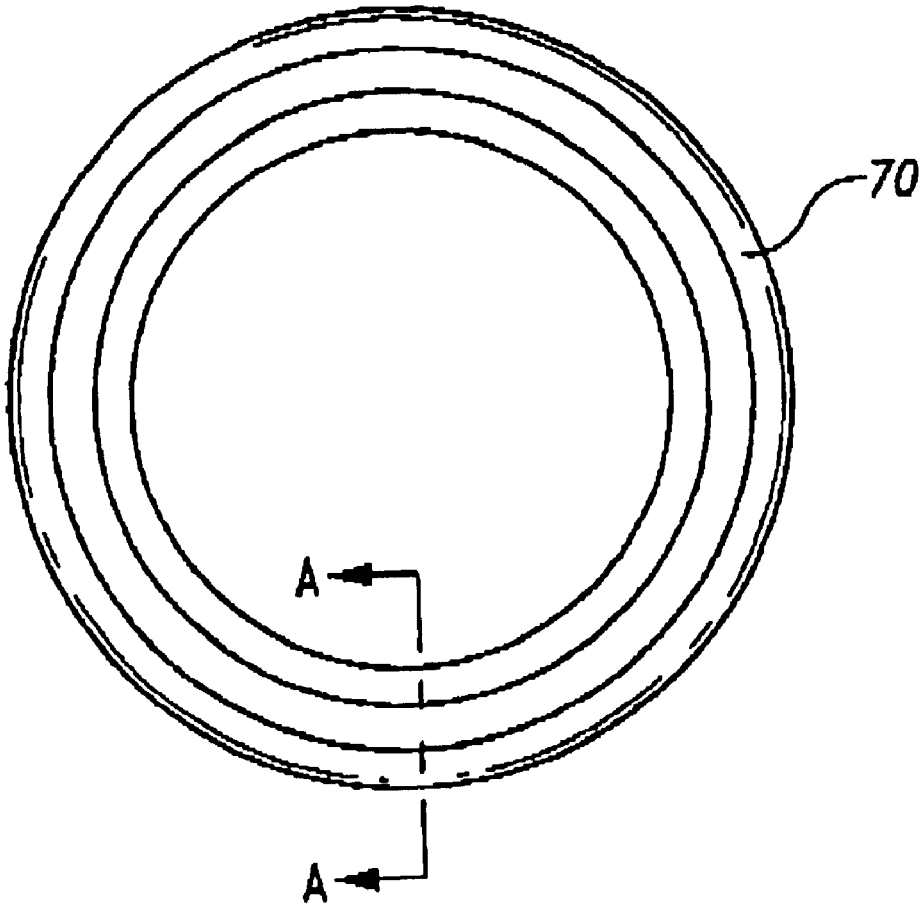
FIG. 3*a* is a top view of a single ridge seal gasket used in the exemplary embodiment of FIG. 1.
Figure 3B:
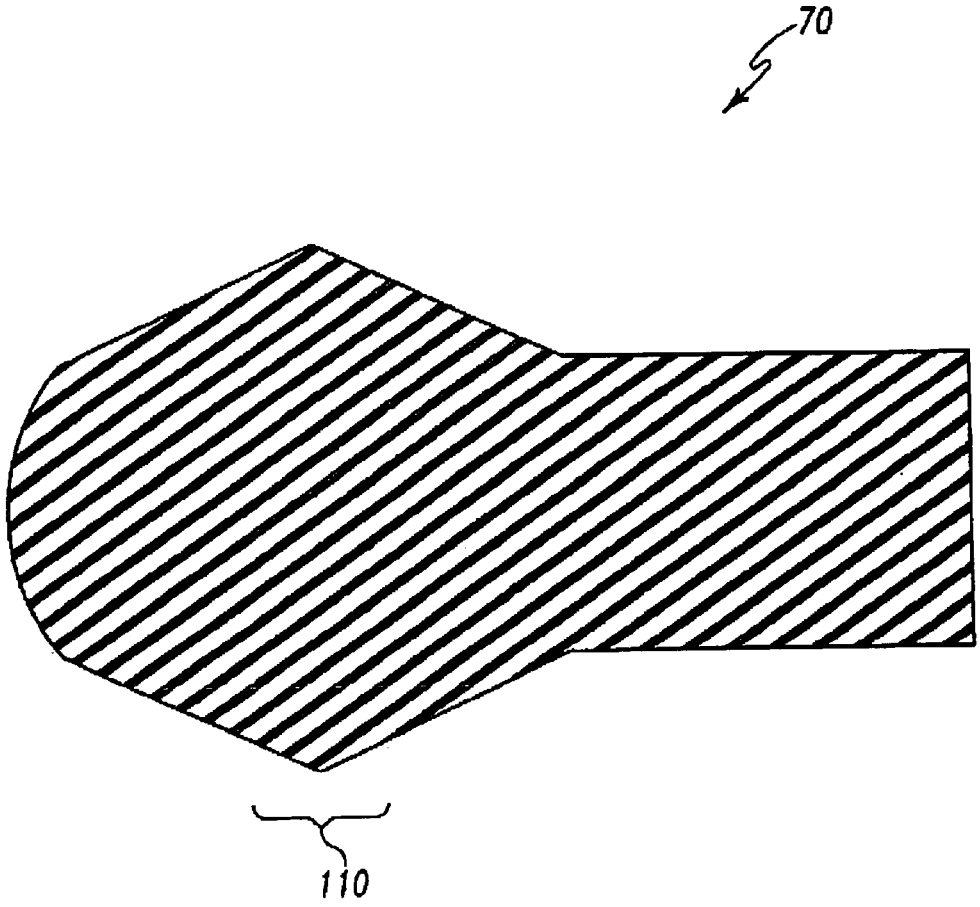
FIG. 3*b* is a cross-sectional view of the single ridge seal gasket along line A—A of FIG. 3*a;*

Referring back to FIG. 1, the W-2 exemplary embodiment of the present invention further comprises a socket to housing seal gasket 70, which encircles lamp bulb socket 100. FIG. 3*a* depicts a top view of an isolated seal gasket 70 and FIG. 3*b* depicts a cross-sectional view of the seal gasket along line A—A of FIG. 3*a*As shown in FIG. 3*b*, seal gasket 70 comprises a thick single ridge 110. In construction, seal gasket 70 is placed over bulb accepting body 20 of socket 100 and slid in between seal flange 80 and lugs 50, so that the seal gasket is kept in place by lugs 50 and by seal flange 80. Referring back to FIGS. 1 and 2, when socket 100 is installed into socket recess 210, seal gasket 70 is pinched in between seal flange 80 and lamp housing 200. In this manner, thick single ridge 110 compresses to create an environmental seal between lamp bulb socket 100 and lamp housing 200. The use of seal gasket 70 with a single ridge 110, instead of a seal gasket with multiple ridges, reduces the force necessary to install the seal gasket and decreases the percentage of seal compression. In this manner, seal 70 eases installation of socket 100 and reduces manufacturing costs of the socket assembly. While the present invention utilizes a single ridge seal gasket 70 to ease installation, it will be appreciated by one skilled in the art that many equivalent types of seal gaskets may be used to construct the disclosed embodiment of the present invention. For example, a seal gasket that utilizes two ribs or three ribs may be used in constructing the present invention.

Figure 4:
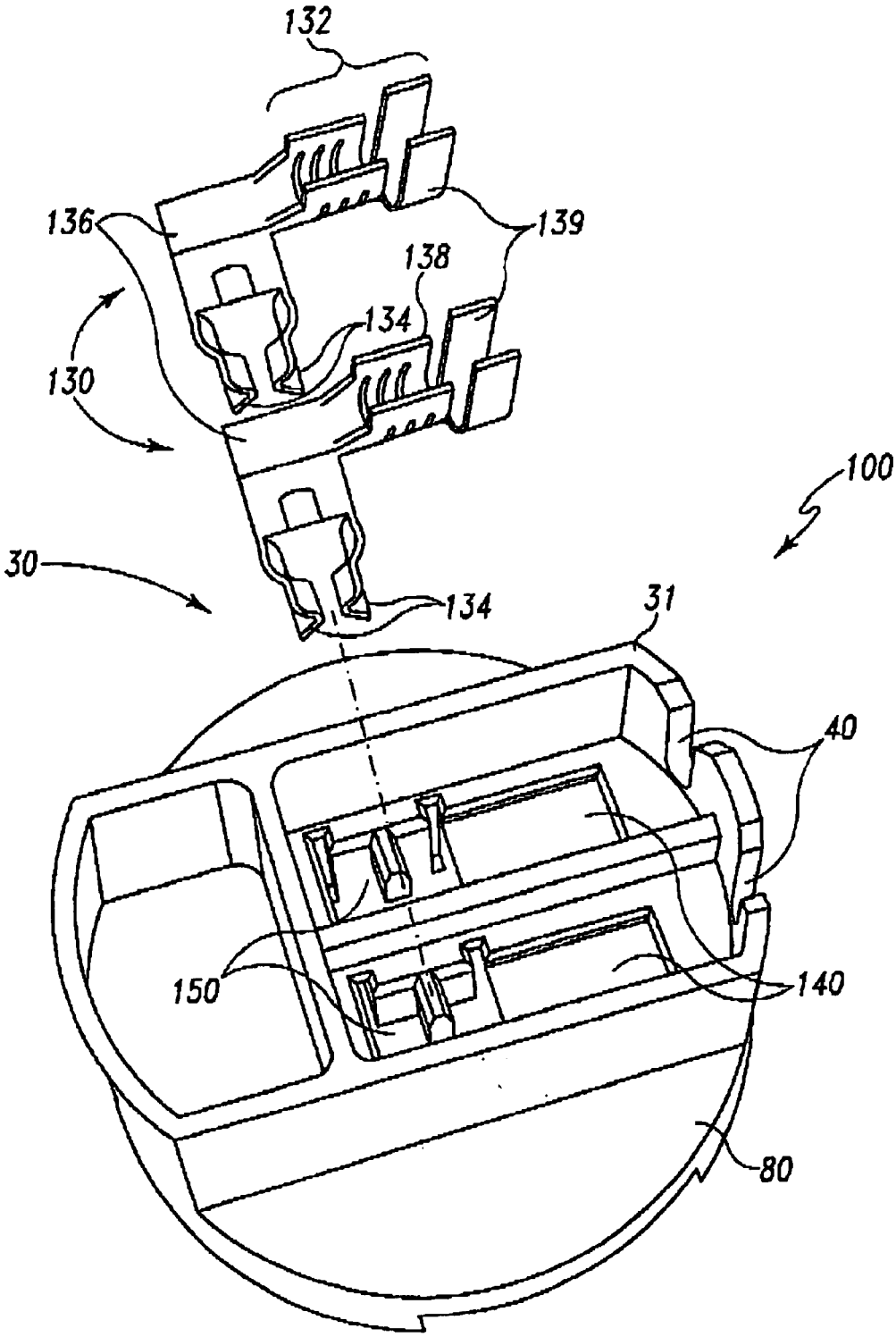
FIG. 4 is an exploded, bottom view of the terminal accepting body of the exemplary lamp bulb socket of FIG. 1.

FIG. 4 displays an exploded top view of terminal accepting body 30 of lamp socket 100. As shown in FIG. 4, this embodiment of the present invention further comprises two one-piece, right-angle wide terminals 130, two right-angle terminal housing channels 140, two terminal blade receiver slots 150, and two harness wire retention slots 40. While the W-2 embodiment comprises two harness wire retention slots, it will be appreciated by one skilled in the art that any number of a plurality of retention slots or no retention slots can be used.

Figure 5:
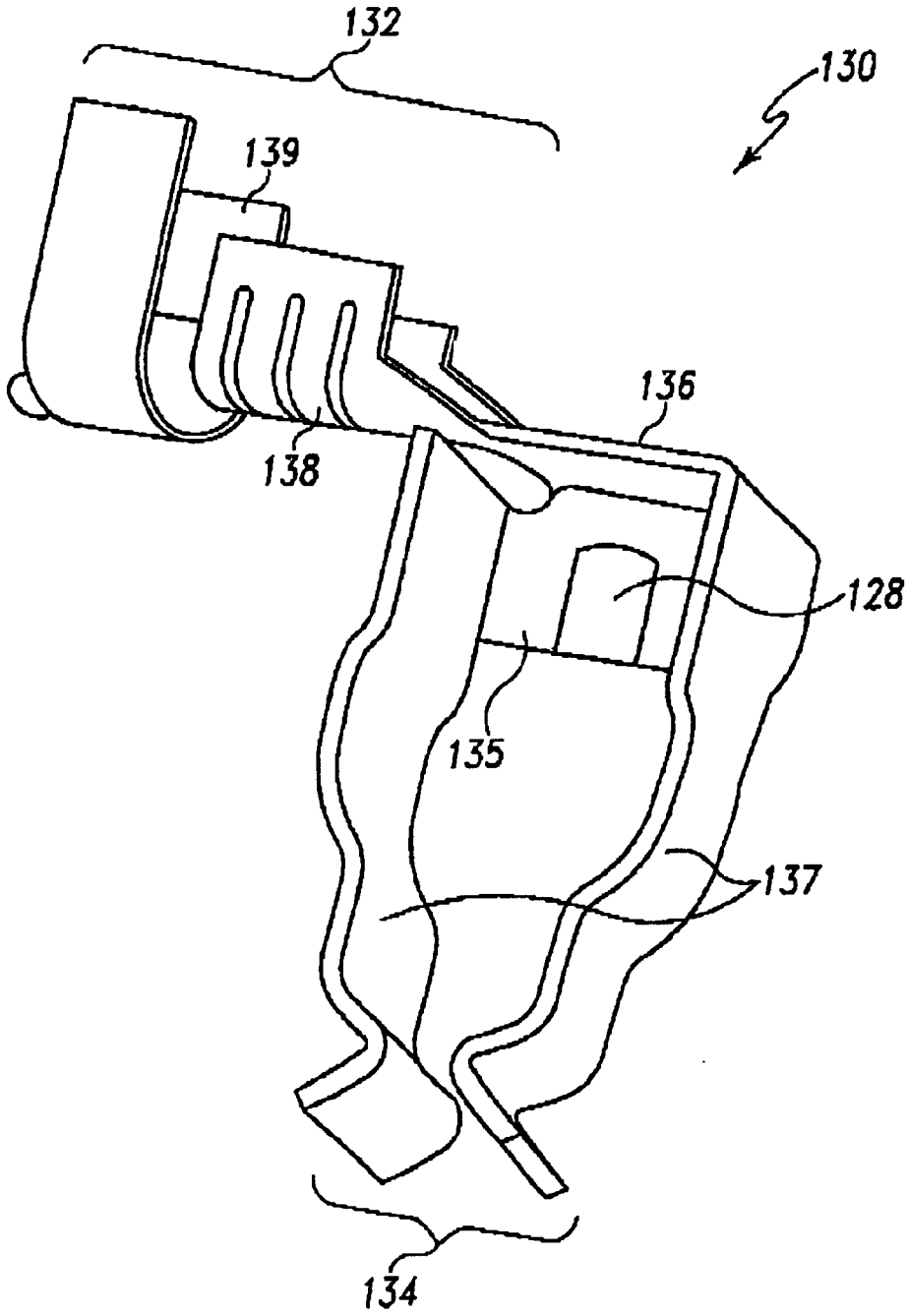
FIG. 5 is a perspective view of a one-piece, right-angle, wide terminal used in the exemplary lamp socket of FIG. 1.

FIG. 5 is a perspective view of right-angle terminal 130. As shown in FIG. 5, terminal 130 comprises a one-piece, right-angle wide terminal design that comprises a terminal lead end 132, a lamp bulb connecting blade 134, and a cover plate 136. While the preferred terminal 130 comprises a one-piece terminal design, it is realized by one skilled in the art that terminal 130 can comprise a two-piece terminal. The wide terminal design of terminals 130 is advantageous, because it makes insertion of the bulb easier and helps prevent harm to the bulb when it is inserted into socket 100. In this embodiment, cover plate 136 is located just above lamp connecting bulb blade 134 and the lamp connecting bulb blade is substantially perpendicular to the cover plate. This embodiment enables cover plate 136 to substantially cover the entire opening of receiver slot 150 when blade 134 is inserted into the receiver slot. Lead end 132 of the terminal 130 is aligned substantially perpendicular to the alignment of blade 134. Lead end 132 is substantially perpendicular to blade 134 because the axis along which wires 160 are inserted into the lead end is substantially perpendicular to the axis along which two prongs 137 of blade 134 extend. In contrast to an axial terminal, right-angle terminals 130 reduce the space needed to house socket 100 because terminal lead ends 132 are located closer to the terminal accepting body 30 of the socket.

Terminal lead end 132 comprises a wire cradle 139 and a wire connecting piece 138. An insulated harness wire 160 (shown in FIG. 17) is laid into wire holding cradle 139 and connecting piece 138. The section of harness wire 160 laying in connecting piece 138 is stripped of insulation and is electrically connected to terminal 130 by crimping connecting piece 138 over the wire. The section of harness wire 160 laying in cradle 139 remains insulated and is held in place by crimping the cradle over the wire. It is appreciated by those of ordinary skill in the art that terminal lead end 132 can comprise either a single crimp terminal lead end or a double crimp terminal lead end. A single crimp terminal lead end 132 allows for one harness wire 160 to be connected to each terminal 130. A double crimp terminal lead end would increase the length of wire cradle 139 and wire connecting piece 138 to allow for two harness wires 160 to be connected to each terminal 130.

Lamp bulb connecting blade 134 comprises two prongs 137. Prongs 137 are the same and each prong can either electrically connect terminal 130 to bulb 10 or serve to hold the lamp bulb in place in combination with a stabilizing feature 170. It will be appreciated by one skilled in the art that each terminal 130 may comprise of many equivalent types of lamp bulb connecting blades to connect the terminals to bulb 10 and is not limited to blade 134 pictured in FIG. 5.

Additionally, terminal 130 can further comprise terminal connecting piece 135. In this embodiment, terminal connecting piece 135 comprises a latch 128 that operates to hold terminals 130 in place when the terminals are inserted into terminal blade receiver slots 150. In operation, each latch 128 will slide into each receiver slot 150 and will expand once terminal 130 is fully inserted into the receiver slot. In this manner, connecting piece 135 interacts with the floor of bulb accepting body 20 of socket 100 to hold terminal 130 in place. It is realized by one skilled in the art that many equivalent types of means exist to connect and hold terminal 130 in place and that this embodiment of the present invention is not limited to connecting piece 135 for connecting the terminal to socket 100.

Referring to FIGS. 4–5, in order to electrically connect terminals 130 to lamp bulb 10, bulb connecting blade 134 is inserted into slots 150 in the posterior of lamp bulb socket 100, so that terminal connecting piece 135 latches terminal 130 into place. Once connecting blades 134 are inserted, terminal lead ends 132 will rest in terminal housing channels 140. In this manner, terminal lead ends 132 are aligned with harness wire retention slots 40 and are positioned sideby-side to one another in terminal accepting body 30 of lamp socket 100. During the assembly process, harness wires 160 (shown in FIG. 17) are attached to terminal lead ends 132 by a method well known in the art, such as, the crimp method already described. Wires 160 are then threaded through and exit socket 100 through wire retention slots 40. Harness wires 160 are then sealed to terminal lead ends 132 and terminal accepting body 30 of socket 100 by the use of a direct potting method.

Direct potting involves the use of a sealing material with adhesive properties to secure the connection of harness wires 160 to terminals 130. The sealing material is poured around the connection of wires 160 to terminals 130, substantially covering the lead end 132 of the terminals 130. In a preferred embodiment, the sealing material fills the terminal accepting body 30 to the rim 31. Cover plate 136 prevents a substantial amount of the sealing material from leaking through slots 150 into the interior of bulb accepting body 20 of socket 100. Although small holes exist between terminals 130 and slots 150, the sealing material is sufficiently viscus and hardens fast enough to prevent significant amounts of the sealing material from flowing into the bulb accepting body 20 of socket 100. Any type of sealing material can be used in sealing wires 160 to terminal lead ends 132 of terminals 130, but it is preferred that quick curing sealing materials, such as a polyurethane or a low pressure mold nylon, be used to allow for quick manufacturing of socket 100. In addition to providing a secure connection, direct potting creates an environmental seal around the connection and in this manner, eliminates any leak path between wires 160 and socket 100. Direct potting also eliminates the need for separate seals to connect terminals 130 to harness wires 160. In this manner, direct potting reduces the number of parts needed to assemble socket 100, reduces manufacturing cost, and reduces the amount of space needed to house the socket.

Once the sealing material hardens, harness wires 160 are sealed to terminals 130 and lamp bulb socket 100. Harness wires 160 are sealed to and exit wire retention slots 40 at about a ninety degree angle from insertion axis 190 (shown in FIG. 1). In this position, socket 100 can be right angle loaded into socket recess 210. Alternatively, after wires 160 are threaded through retention slots 40 and sealed to terminals 130 and socket 100, the wires can be bent approximately ninety degree so that the harness wires exit the socket substantially parallel to insertion axis 190. In this position, socket 100 can be axially loaded into socket recess 210. In an embodiment without retention slots 40, harness wires 160 are sealed to and exit socket 100 substantially parallel to insertion axis 190. In this position, socket 100 can be axially loaded into socket recess 210. Alternatively, after wires 160 are sealed to and exit socket 100, the wires can be bent approximately ninety degrees so that the harness wires exit the socket substantially perpendicular to insertion axis 190. In this position, socket 100 can be right angle loaded into socket recess 210.

Figure 6A:
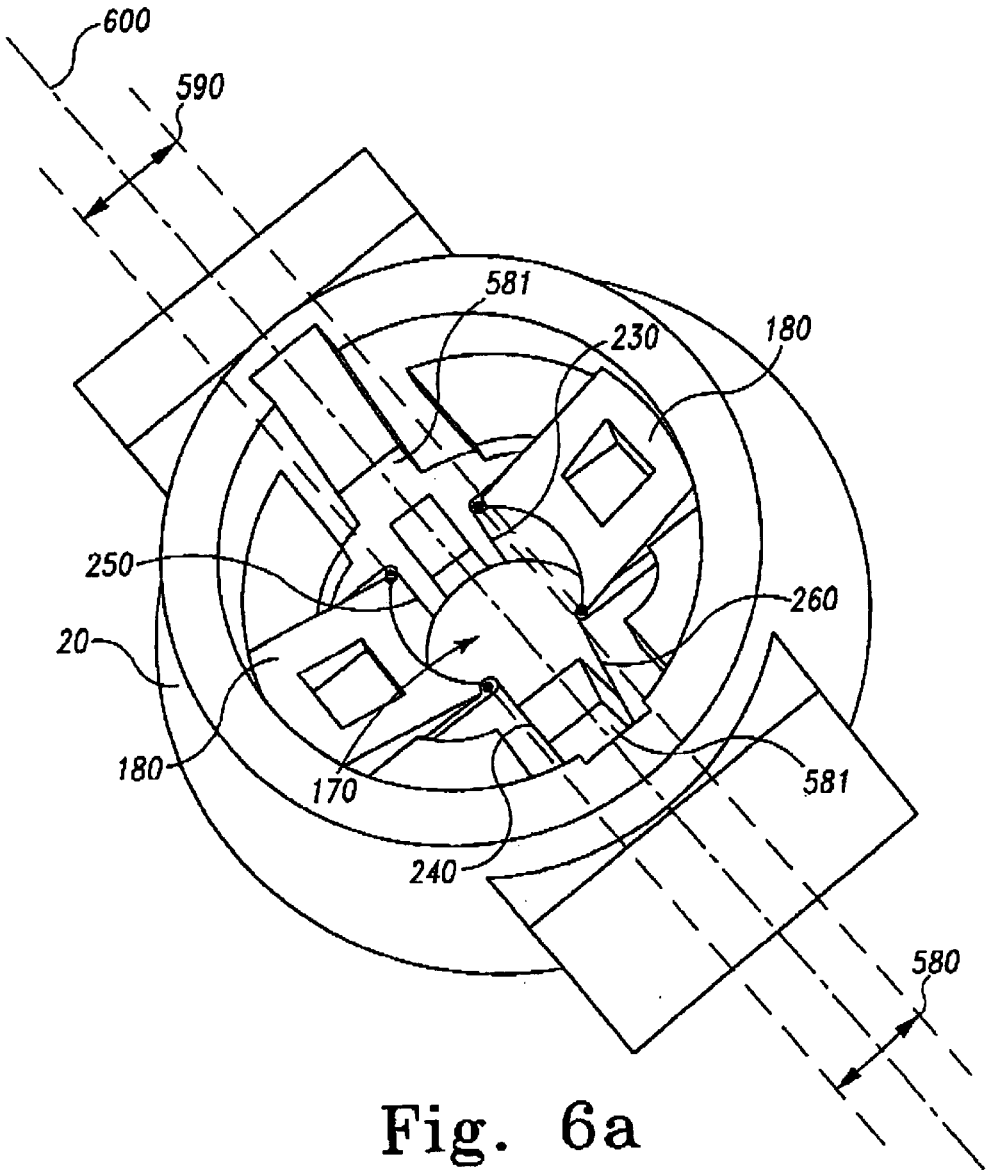
FIG. 6*a* is a top perspective view of the bulb accepting body of the exemplary lamp bulb socket of FIG. 1.
Figure 7:
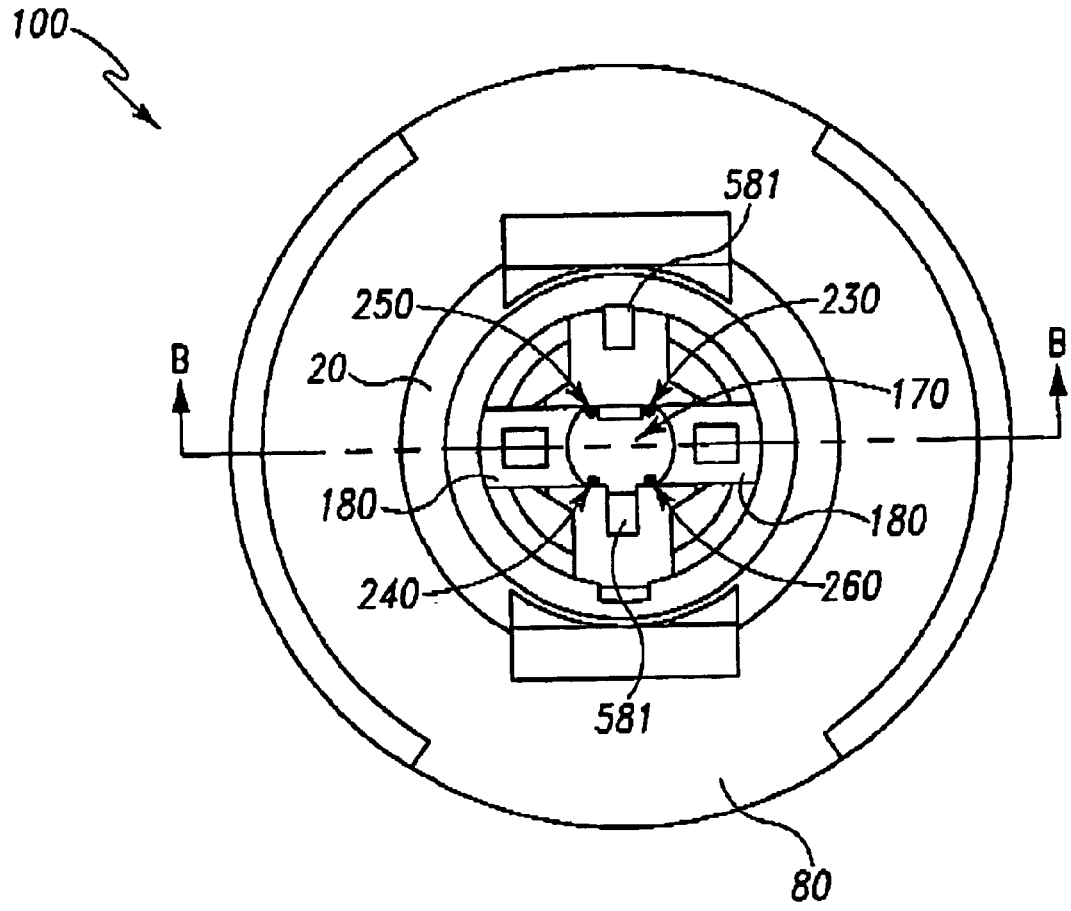
FIG. 7 is a top view of the bulb accepting portion in relation to the lamp bulb socket of FIG. 1.
Figure 8:
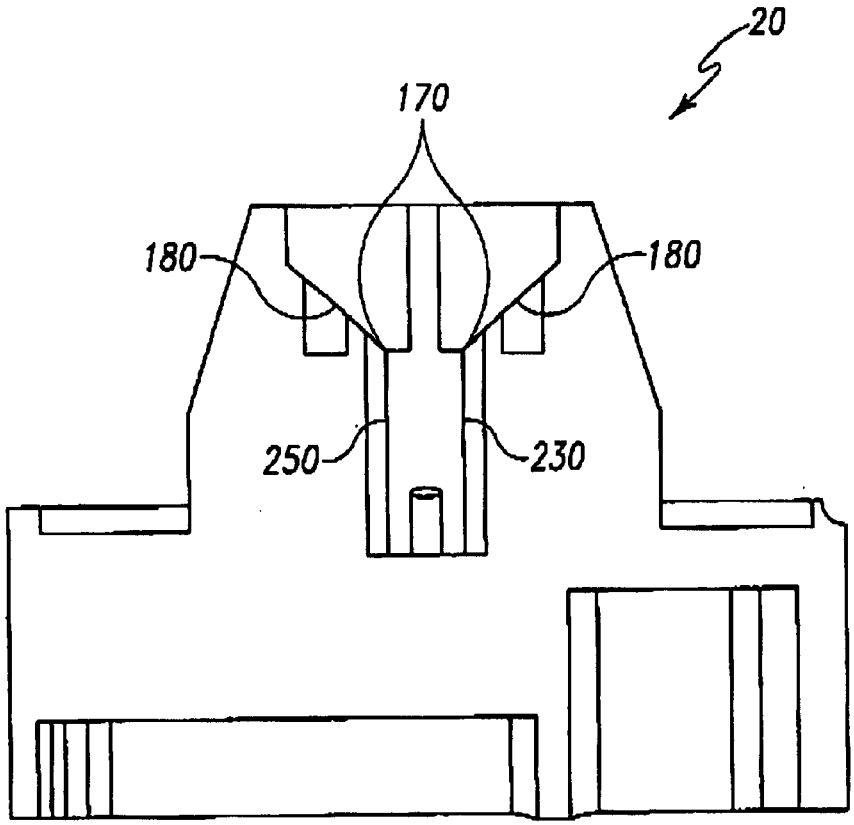
FIG. 8 is a cross-sectional view of the bulb stabilizing feature along line B—B of FIG. 7.

As shown in FIG. 6*a*, the W-2 embodiment of lamp bulb socket 100 further comprises a bulb stabilizing feature 170. FIG. 6*a* shows a top perspective view of bulb accepting body 20 of lamp bulb socket 100 with bulb 10 removed. FIG. 7 shows a top view of bulb accepting body 20 in relation to socket 100. FIG. 8 shows a cross-sectional view along line B—B of FIG. 7 of bulb accepting body 20 and bulb stabilizing feature 170. Stabilizing feature 170 works in conjunction with terminals 130 (not pictured in FIG. 6*a*–FIG. 8) to minimize bulb wobbling, to provide bulb retention, and to provide electrical contact between the terminals and bulb 10. Referring to FIG. 6*a*, bulb stabilizing feature 170 comprises angular ribs 180 which are molded to form four opposing edges: edge A 230, edge B 240, edge X 250, and edge Y 260. Diagonally opposed edge A 230 and edge B 240 define a first distance 580 in relation to a centerline 600, and diagonally opposed edge X 250 and edge Y 260 define a second distance 590 in relation to the centerline. First distance 580 equals the perpendicular distance from edge A 230 to centerline 600 plus the perpendicular distance from edge B 240 to centerline 600. Second distance 590 equals the perpendicular distance from edge X 250 to centerline 600 plus the perpendicular distance from Y 260 to centerline 600. The second distance 590 is greater than the first distance 580. In this embodiment, bulb flange channels 581 are provided on opposite sides of the angular ribs 180. Stabilizing feature 170 allows socket 100 to accept various bulb types of various sizes.

Figure 6B:
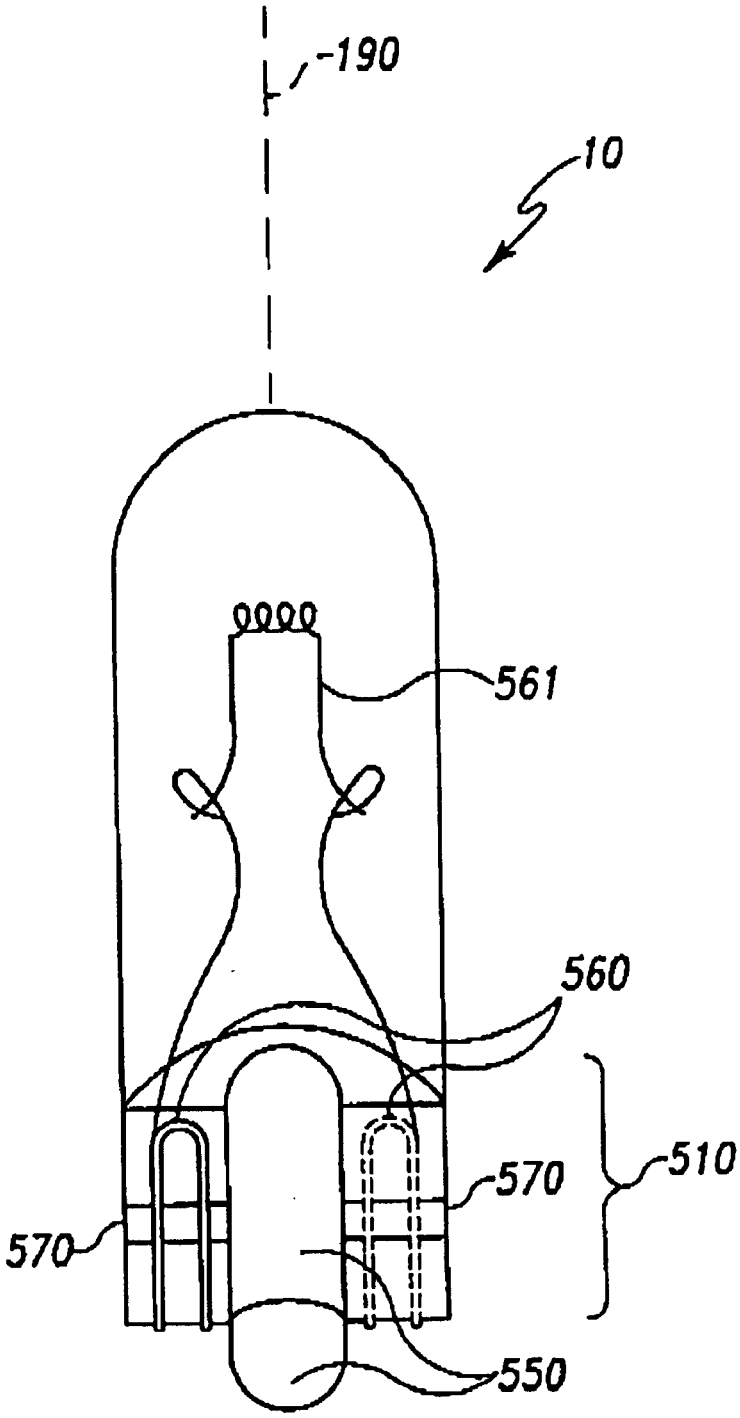
FIG. 6*b* is a front view of a bulb used in the exemplary lamp socket of FIG. 1.
Figure 6C:
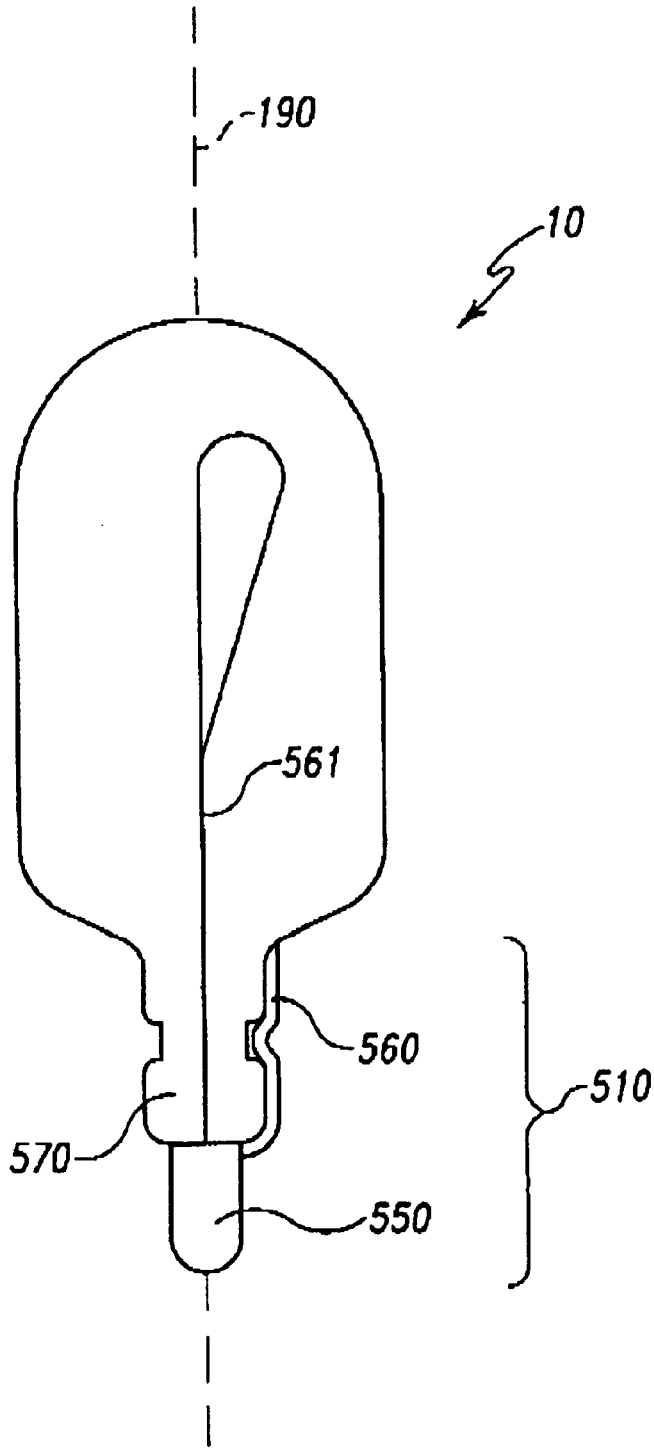
FIG. 6*c* is a side view of the bulb of FIG. 6*b;*

FIG. 6*b* shows a front view and FIG. 6*c* shows a side view of bulb 10 and bulb base 510. Bulb 10 comprises base 510 that includes cylindrical portion 550, flange portions 570, and bulb leads 560. Bulb leads 560 electrically connect to filament 561. Bulb 10 is inserted into bulb accepting body 20 of lamp bulb socket 100 by aligning flange portions 570 of the bulb base 510 with bulb flange channels 581 so, that the flange portions 570 will fit into these channels (see FIG. 6*a*–6*c*. When flange portion 570 of bulb base 510 has a thickness greater than first distance 580 and is inserted into socket 100, the flange portion will contact diagonally opposed edge A 230 and edge B 240 and force the bulb base to slightly rotate about bulb insertion axis 190. Rotation of bulb 10 forces flange portions 570 against the spring tension of terminals 130, which are inserted into the flange channels 581. When bulb base 510 is inserted into socket 100, flange bulb base portions 570 will be kept in place by lamp bulb connecting blades 134 of terminals 130 and bring bulb leads 560 into electrical contact with terminals 130. This creates a tight grip on bulb base 510 and secures bulb 10 in place. In this manner, bulb stabilizing feature 170 creates a tight grip on bulb base 510, secures bulb 10 in place and prevents the bulb from wobbling.

Figure 9:
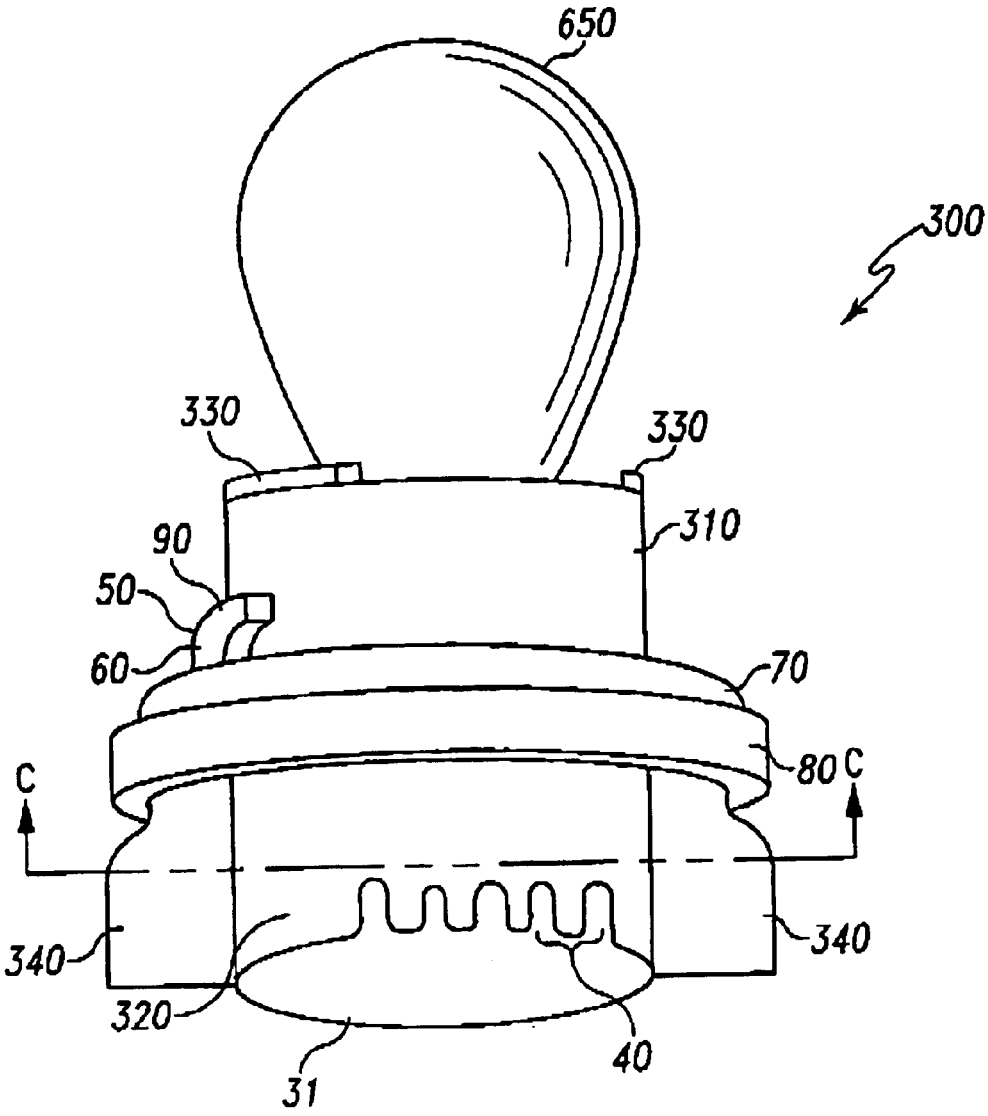
FIG. 9 is a side view of the W-3 exemplary lamp bulb socket of the present invention.

In FIG. 9, the W-3 embodiment of the present invention is shown fully assembled comprising a bulb 650 and a lamp bulb socket 300. Bulb socket 300 comprises a bulb accepting body 310 connected to a terminal accepting body 320, a plurality of wire retention slots 40, three lugs 50 (only one pictured) molded onto the side of bulb accepting body 310, exterior alignment features 330, a seal gasket 70, and a seal flange 80.While the W-3 embodiment comprises three lugs 50, it will be appreciated by one skilled in the art that no lugs, a single lug or any number of a plurality of lugs can be used. In this embodiment, lugs 50 comprising stop feature 60 and lock feature 90, seal gasket 70, seal flange 80; rim 31, and harness wire retention slots 40 perform the same function as described in the W-2 embodiment. Accordingly, the W-3 embodiment of the present invention can be loaded into socket recess 210 (shown in FIG. 3) in the same manner as the W-2 embodiment.

Further, lamp bulb socket 300 may optionally comprise socket insertion wings 340. Socket insertion wings 340 provide an operator with a part of socket 300 to grasp and use to insert lamp socket 300 into lamp housing 200. This provides for easier installation and prevents damage to socket 300 and bulb 650 during the installation process. While the exemplary embodiment comprises two insertion wings 340, it will be appreciated by those of ordinary skill in the art that any number of insertion wings may optionally be used in the present invention.

Figure 10:
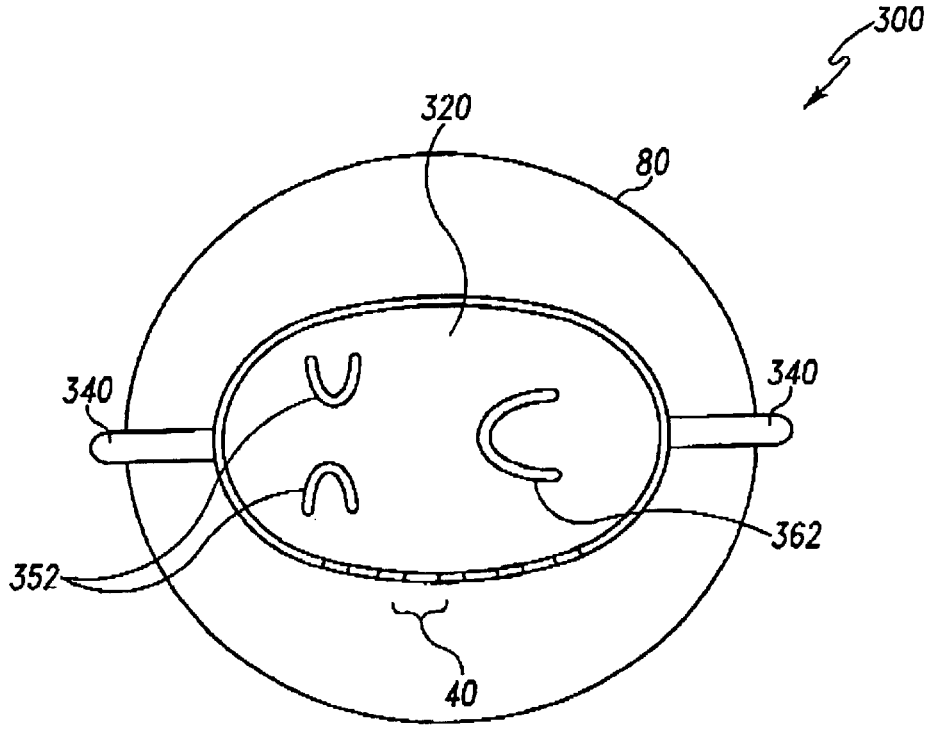
FIG. 10 is a bottom view of the terminal accepting body of the exemplary lamp bulb socket of FIG. 9.
Figure 11:
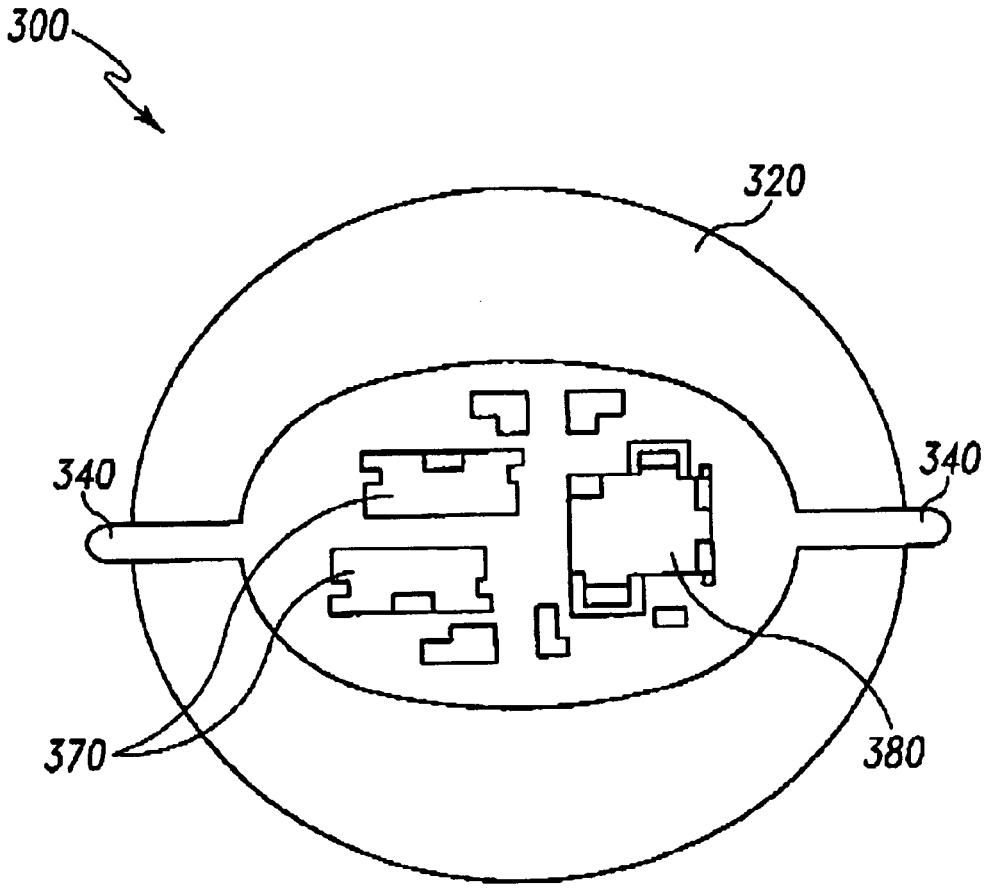
FIG. 11 is a cross-sectional view of the terminal accepting body along line C—C of FIG. 9.

FIG. 10 displays a bottom view of terminal accepting body 320 of lamp bulb socket 300. In the W-3 embodiment, lamp bulb socket 300 further comprises two major/minor terminals 350 with a major/minor terminal lead end 352 and ground terminal 360 with a ground terminal lead end 362. FIG. 11 displays a cross-sectional view along line C—C of FIG. 9 of terminal accepting body 320. As shown in FIG. 11, lamp bulb socket 300 further comprises two major/minor receiver slots 370 and a ground terminal receiver slot 380 for receiving two major/minor terminals 350 and ground terminal 360 respectively (shown in FIGS. 12 and 13). As shown in FIG. 10, an assembled socket 300 has major/minor terminal lead ends 352 and ground terminal lead end 362 protruding out of the posterior of the lamp socket. While the W-3 embodiment of the present invention comprises two major/minor terminals 350, it will be appreciated by one skilled in the art that this embodiment of the present invention can comprise one or two major/minor terminals 350.

Figure 12:
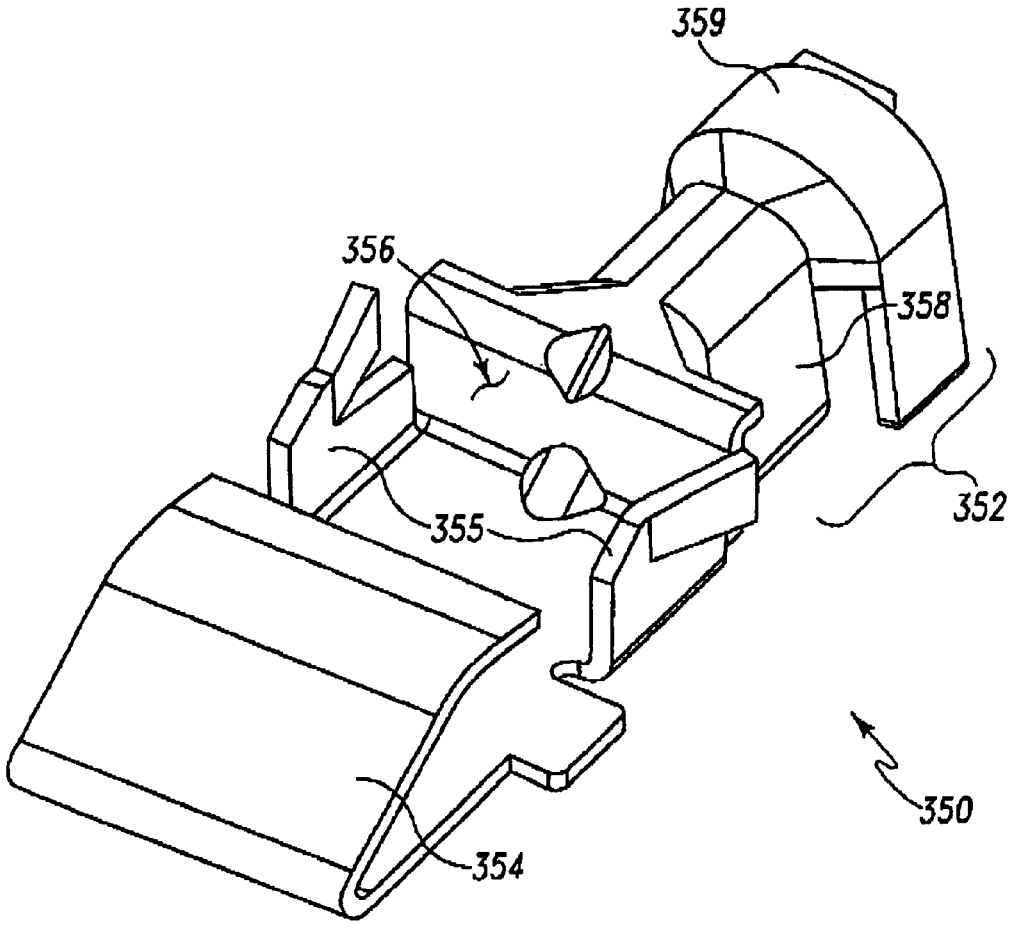
FIG. 12 is a perspective view of a one-piece major/minor terminal used in the exemplary lamp bulb socket of FIG. 9.

Referring to FIG. 12, major/minor terminals 350 comprise a one-piece, axial terminal assembly that comprises major/minor terminal lead end 352, a lamp bulb connecting blade 354, and a cover plate 356. Terminal lead end 352 comprises a wire connecting piece 358 and a wire cradle 359. Terminal lead end 352 electrically connects major/minor terminal 350 to harness wires 160 in the same manner as terminal lead ends 132 of the W-2 embodiment connect to harness wires 160. It is appreciated by those of ordinary skill in the art that major/minor terminal lead ends 352 can comprise either a single crimp terminal lead end or a double crimp terminal lead end. Further, while terminals 350 comprise a one-piece major/minor terminal design, one skilled in the art realizes that terminals 350 can comprise a two-piece major/minor terminal design.

Cover plate 356 is located below connecting blade 354 so that when connecting blade 354 is axially inserted into major/minor terminal receiver slot 370, the cover plate will cover the entire opening of receiver slot 370. It will be appreciated by one skilled in the art that major/minor terminal 350 may comprise of many equivalent types of lamp bulb connecting blades to connect major/minor terminals to bulb 650 and is not limited to blade 354 pictured in FIG. 12. Additionally, major/minor terminal 350 can further comprise terminal connecting pieces 355. When terminal 350 is inserted into major/minor receiver slots 370, connecting pieces 355 will slide into the slots and expand once the terminal is fully inserted. In this manner, connecting pieces 355 interact with the floor of the bulb accepting body 310 of socket 300 to hold major/minor terminals 350 in place.

Figure 13:
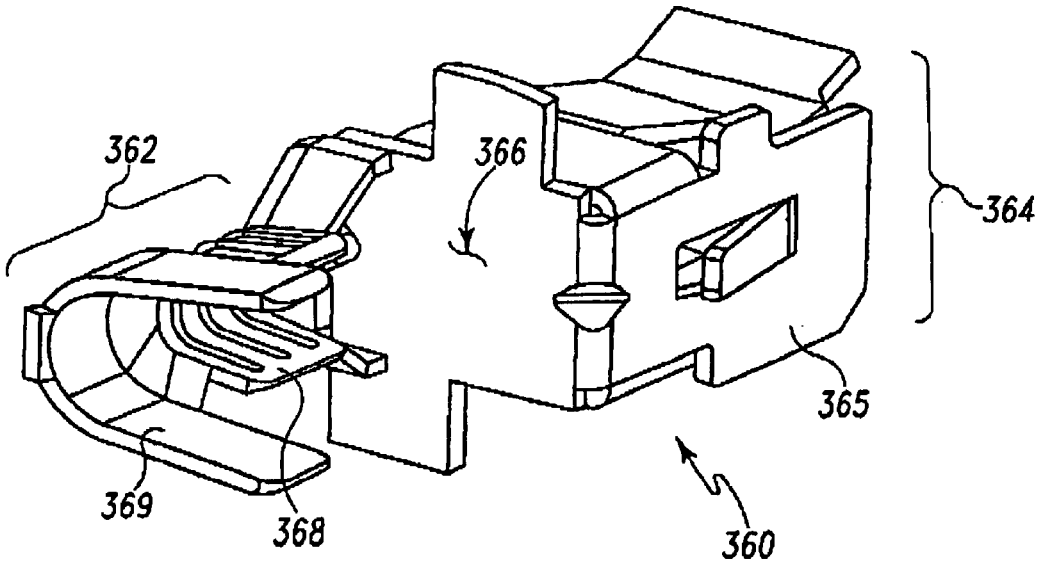
FIG. 13 is a perspective view of a ground terminal used in the exemplary lamp bulb socket of FIG. 9.

Referring to FIG. 13, ground terminal 360 comprises ground terminal lead end 362, a ground lamp bulb connecting blade 364 and a ground terminal cover plate 366. Ground terminal lead end 362 comprises a wire connecting piece 368 and a wire cradle 369. Terminal lead end 362 electrically connects ground terminal 360 to harness wires 160 in the same manner as terminal lead ends 132 of the W-2 embodiment connect to harness wires 160. It is appreciated by those of ordinary skill in the art that ground terminal lead end 362 can comprise either a single crimp terminal lead end or a double crimp terminal lead end. Further, while terminal 360 comprises a one-piece ground terminal design, one skilled in the art realizes that terminal 360 can comprise a two-piece ground terminal design.

Cover plate 366 is located below connecting blade 364 so that when the connecting blade is inserted into ground terminal receiver slot 380, the cover plate will substantially cover the entire opening of ground terminal receiver slot 380. It will be appreciated by one skilled in the art that ground terminal 360 may comprise many equivalent types of lamp bulb connecting blades to electrically connect ground terminal 360 to bulb 650 and is not limited to blade 364 pictured in FIG. 13. Additionally, ground terminal 360 can further comprise terminal connecting piece 365. When terminal 360 is inserted into ground terminal receiver slots 380, connecting piece 365 will slide into the slot and expand once the ground terminal is fully inserted. In this manner, connecting piece 365 interacts with the floor of bulb accepting body 310 of socket 300 to hold ground terminal 360 in place.

Referring back to FIGS. 10–12, in order to electrically connect two major/minor terminals 350 and ground terminal 360 to a lamp bulb, major/minor bulb connecting blades 354 and ground bulb connecting blade 364 are inserted into major/minor receiver slots 370 and ground receiver slot 380 respectively. During the assembly process, harness wires 160 (shown in FIG. 17) are attached to major/minor terminal lead ends 352 and to ground terminal lead end 362 by a method well known in the art, such as the crimp method. Harness wires 160 are threaded through harness wire retention slots 40. Wires 160 are then sealed to major/minor terminal lead ends 352, ground terminal lead end 362 and terminal accepting body 320 by the use of the direct potting method already described. After harness wires 160 are sealed, the wires are in a position that allows socket 100 to be right angle loaded into socket recess 210. Alternatively, after wires 160 are threaded through retention slots 40 and sealed to major/minor terminals 350, ground terminal 360, and socket 300, the wires can be bent approximately ninety degree so that the harness wires exit the socket substantially parallel to insertion axis 190. In this position, socket 300 can be axially loaded into socket recess 210.

Figure 14:
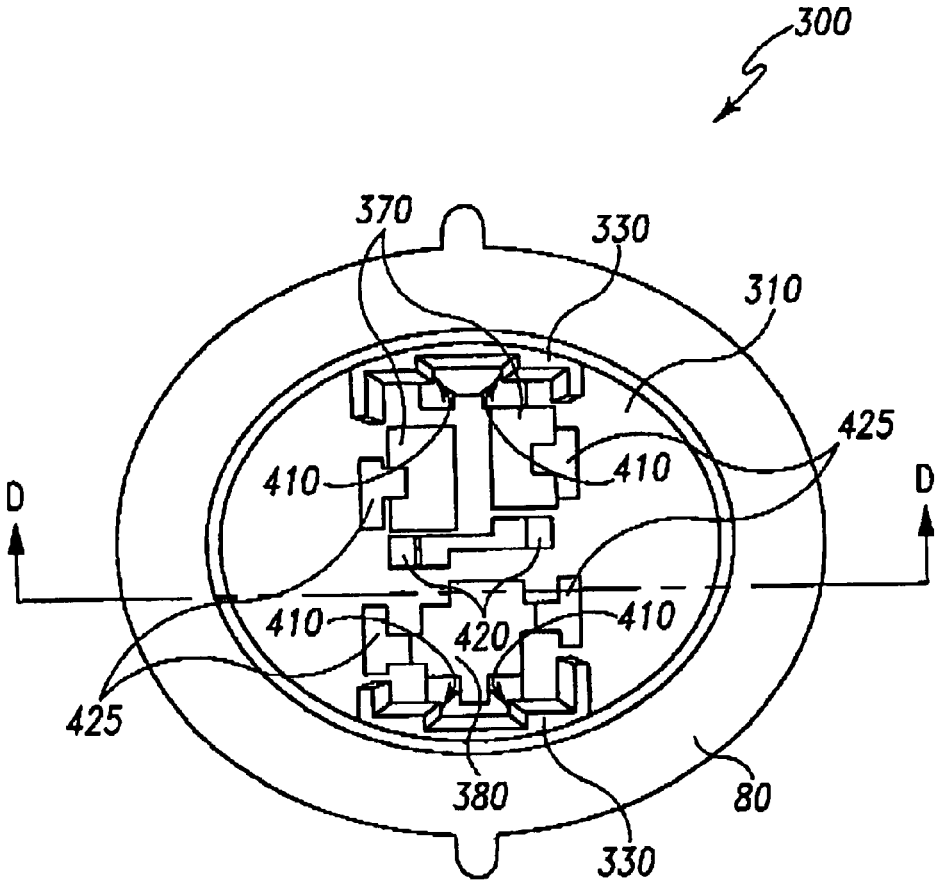
FIG. 14 is a top view of the interior of the bulb accepting body of the exemplary lamp bulb socket of FIG. 9.
Figure 15A:
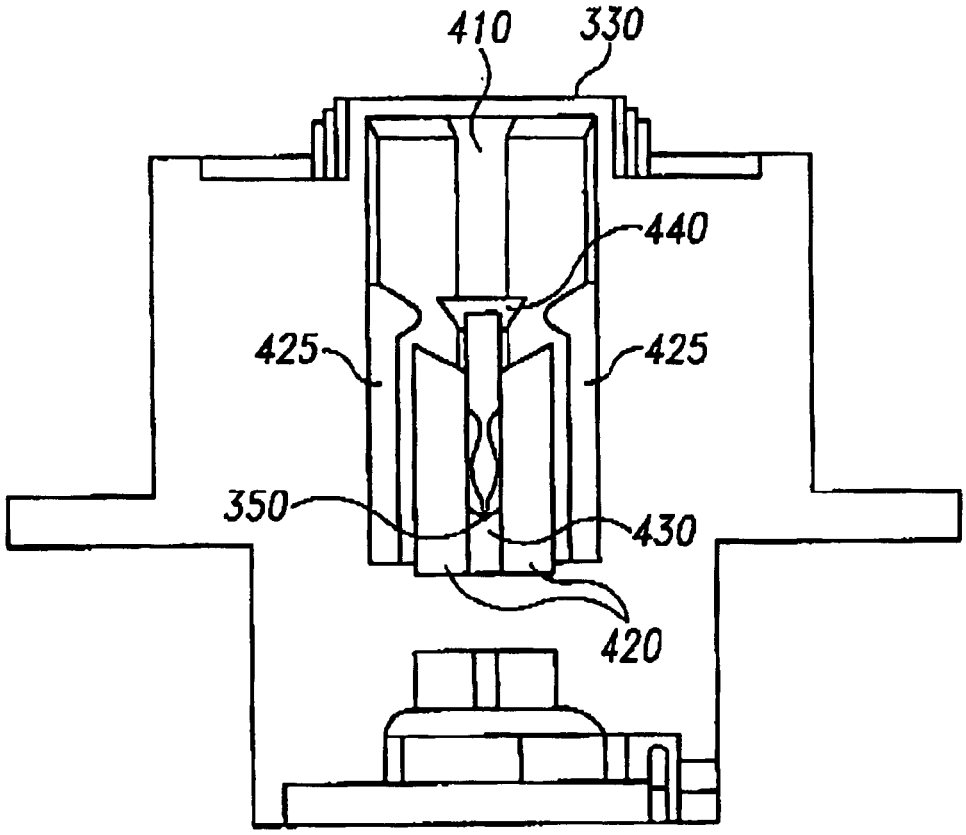
FIG. 15*a* is a cross-sectional view of the interior of the bulb accepting body along line D—D of FIG. 14.

As shown in FIGS. 14 and 15*a*, lamp bulb socket 300 further comprises exterior alignment features 330 that include side rail alignment channels 410 and interior alignment features that include retention arms 425, centrally located angular ribs 420 and an axial channel 430. Axial channel 430 is located between angular ribs 420. FIG. 14 displays a top view of bulb accepting body 310 of socket 300 and exterior alignment features 330 that comprise side rail alignment channels 410. In the present embodiment, side rail alignment channels 410 are notches made on opposing sides of the interior of the lamp bulb socket wall. Side rail alignment channels 410 run from the top of lamp bulb socket 300 down to minor/major terminals 350 and ground terminal 360, when the terminals are inserted into slots 370 and 380. The height of side rail alignment channels 410 is optimally set in relation to the height of terminals 350 to provide for initial bulb 650 (shown in FIG. 9) entry alignment. Side rail channels 410 include angular seats 440. In this manner, side rail alignment channels 410 line up the base of bulb 650 with major/minor terminals 350 and ground terminal 360 and limit the rotational and lateral movement of the lamp bulb within the walls of lamp bulb socket 300.

FIG. 15*a* displays a cross-sectional view of the interior of the bulb accepting body along line D—D of FIG. 14. As shown in FIG. 15*a*, the interior of bulb accepting body further comprises centrally located angular ribs 420 and an axial channel 430 between the angular ribs. While the W-3 embodiment of the present invention comprises two centrally located angular ribs 420 and one axial channel 430, one skilled in the art appreciates that the present invention can comprise any number of angular ribs and axial channels.

Figure 15B:
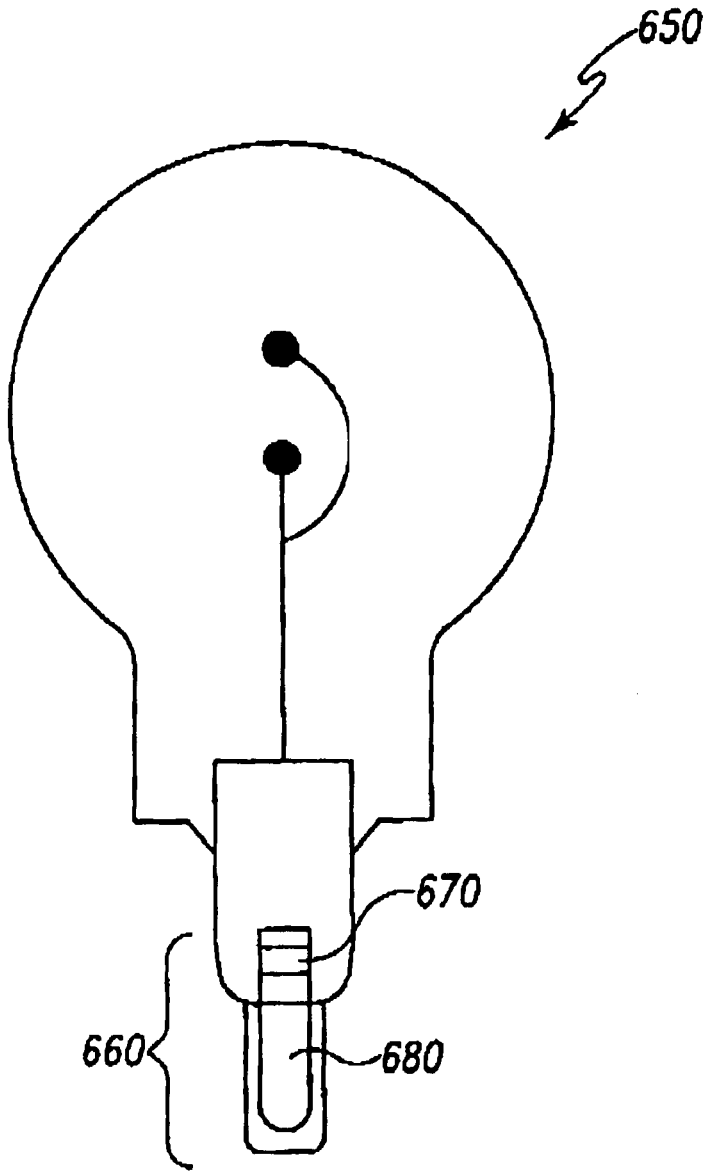
FIG. 15*b* is a side view of a bulb used in the exemplary lamb bulb socket of FIG. 9.
Figure 15C:
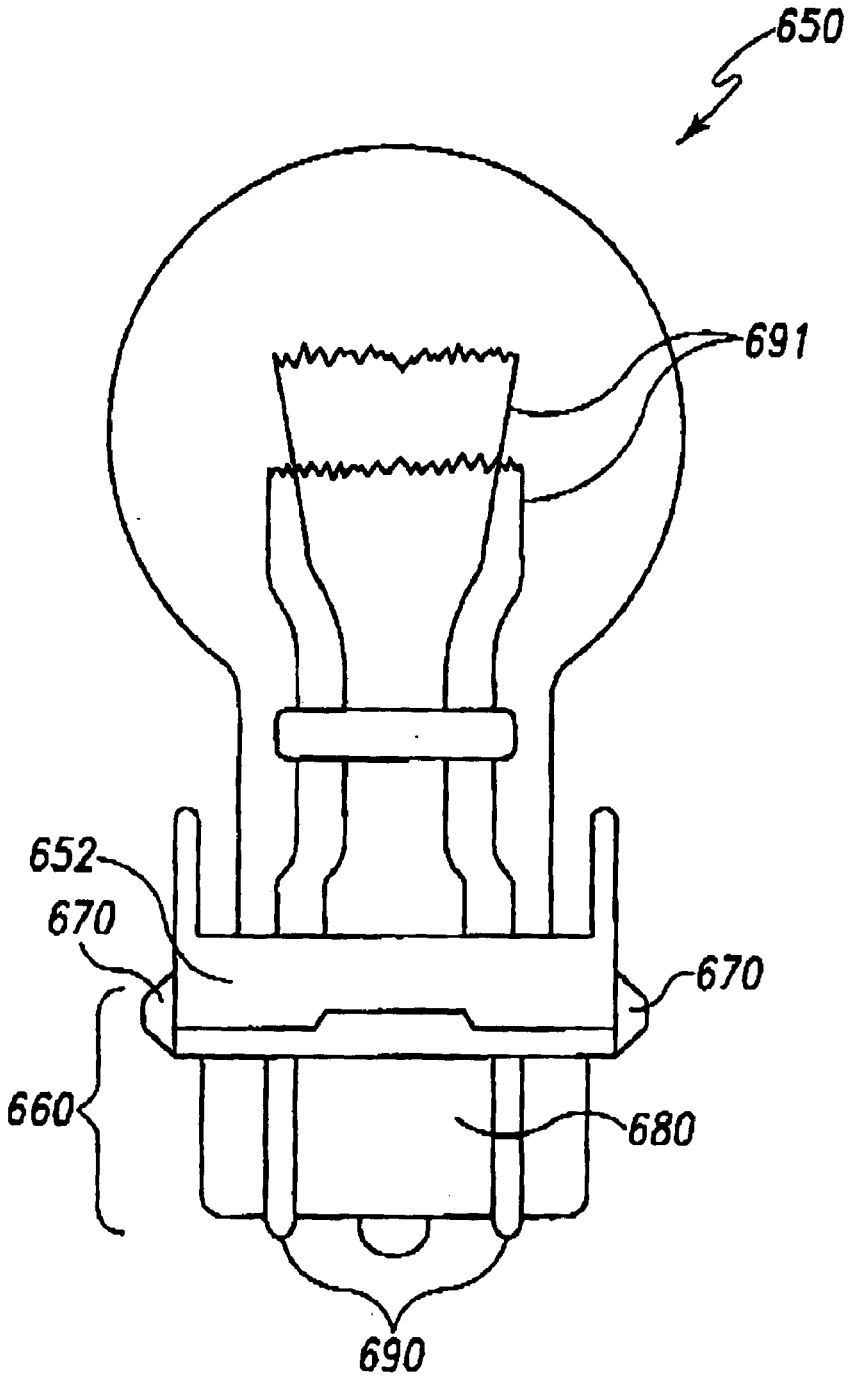
FIG. 15*c* is a front view of the bulb of FIG. 15*b;*

FIG. 15*b* shows a side view and FIG. 15*c* shows a front view of bulb 650. Bulb 650 comprises base 660 that includes bulb collar 652, key tabs 670, flange portion 680, and bulb leads 690. Bulb leads 690 electrically connect to filament 691. When bulb 650 is inserted into bulb accepting body 310, key tabs 670 of the bulb (see FIG. 15*c*) first slide down side rail alignment channels 410 until they contact angular seats 440. As the bulb continues into bulb accepting body, angular ribs 420 direct flange portion 680 toward and into axial channel 430. Flange portion 680 then enters axial channel 430 which is designed and dimensioned to hold the center of the flange portion. In this manner, angular ribs 420 further guides base 660 of bulb 650 into proper alignment with major/minor terminals 350 and assure clearance between the lamp bulb and the major/minor terminals. At the same time, axial channel 430 accepts the center of the flange portion 680. Further, angular ribs 420 and axial channel 430 protect the tops of terminals 350 during bulb insertion and ensure that bulb 650 does not hit the tops of terminals 350 and break. Bulb 650 is inserted until the tops of retention arms 425 clip onto bulb collar 652.

Figure 16:
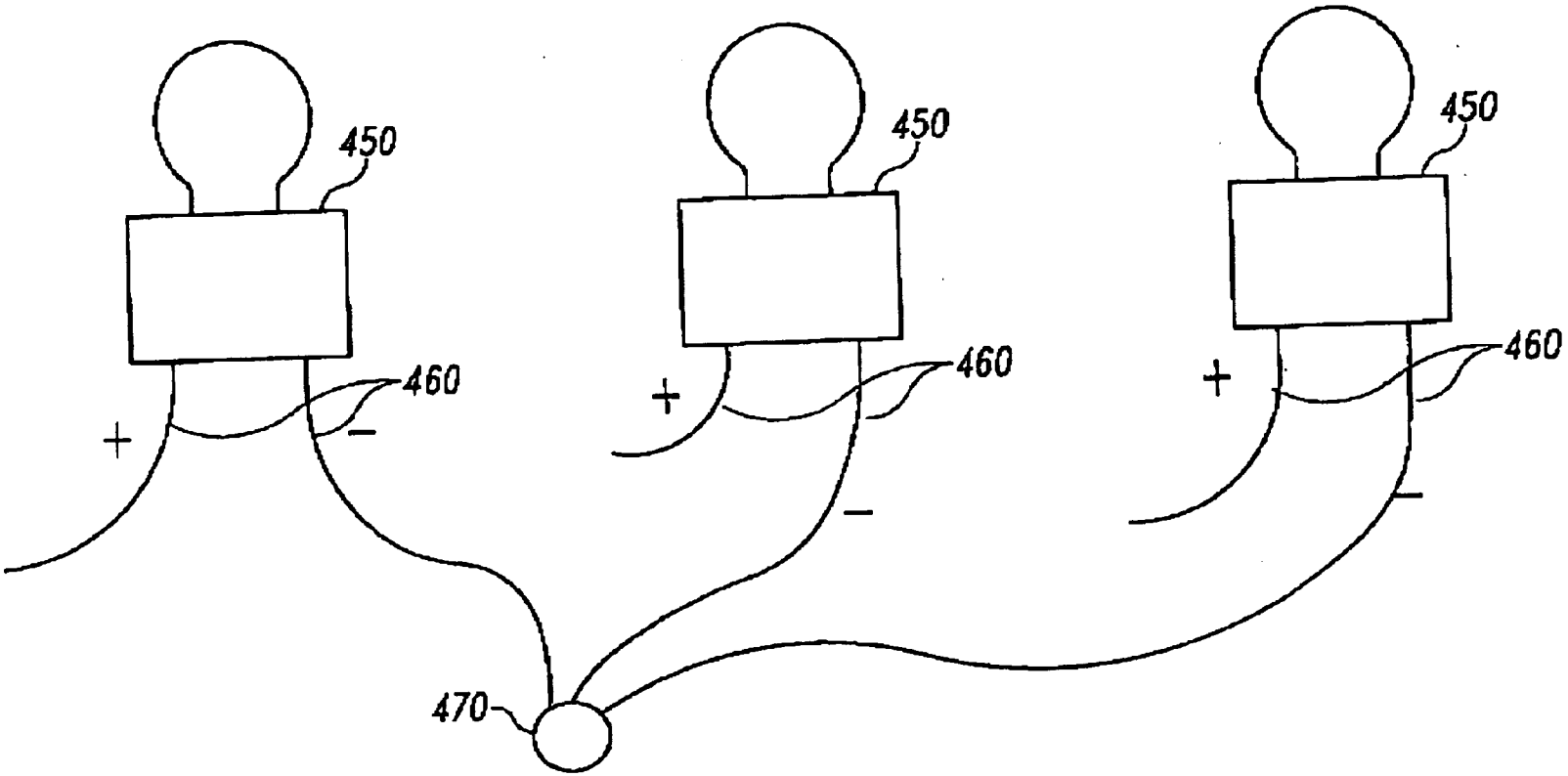
FIG. 16 is a side view of the prior art method of electrically connecting a plurality of lamp bulb sockets together with harness wires spliced together.
Figure 17:
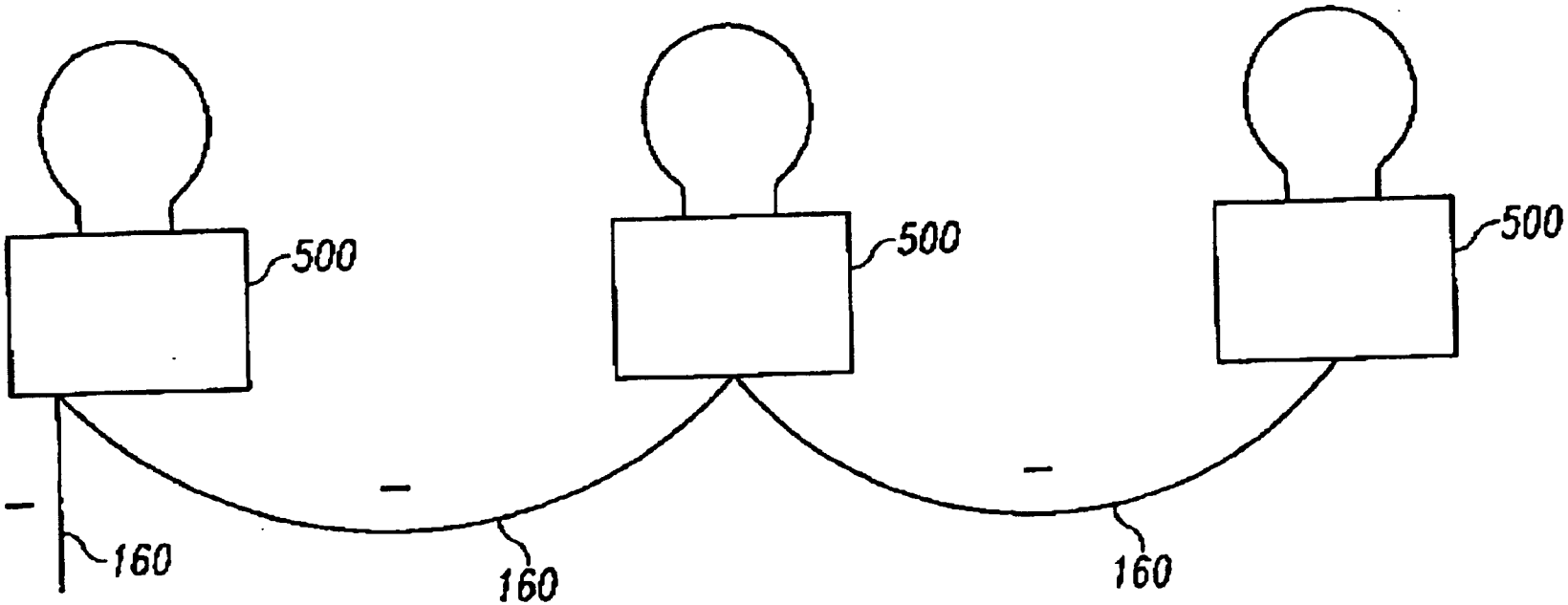
FIG. 17 is a side view illustrating the wiring method of the present invention where a single wire is daisy-chained between the individual lamp bulb sockets.

Both of the embodiments of the present invention allow for a new wiring configuration in automotive lighting. Referring to FIG. 16, the prior art method of electrically connecting a plurality of lamp bulb sockets 450 utilizes two individual harness wires 460 connected to each socket. Harness wires 460 are then spliced together to form an electrical connection 470. As shown in FIG. 17, the present invention, in contrast to the prior art, allows for a plurality of sockets 500 to be "daisy chained" together by harness wires 160. Daisy chaining is possible in the present invention because the direct potting method allows for a lamp socket to make an environmental seal around a terminal connected to multiple wires. In this configuration, wires 160 travel directly from one lamp bulb socket 500 to another. This method reduces the number of splices and wire seals that need to be employed resulting in decreased manufacturing costs.

While the present invention has been described in considerable detail with reference to particular embodiments thereof, such is offered by way of non-limiting examples of the invention as many other versions are possible. It is anticipated that a variety of other modifications and changes will be apparent to those having ordinary skill in the art and that such modifications and changes are intended to be encompassed within the spirit and scope of the appended claims.

What is claimed is:

1. An automotive lamp bulb socket assembly comprising:

a. a bulb accepting body portion;

b. a terminal accepting body portion integral with the bulb accepting body portion c. a sealing material positioned in the terminal accepting body; and d. at least one terminal positioned in the bulb socket, the at least one terminal having:

(i) a blade extending into the bulb accepting body portion, (ii) a lead end substantially perpendicular to the blade and positioned in the terminal accepting body portion so that the lead end is substantially covered by the sealing material, and (iii) a substantially flat cover plate substantially parallel to and integral with the lead end and substantially perpendicular to mud integral with the blade, the cover plate positioned in the bulb socket so that the cover plate is substantially covered by the sealing material and prevents the sealing material from entering the bulb accepting body portion.

2. The bulb socket assembly of claim 1 wherein the bulb accepting body portion further comprises a plurality of ribs forming a first edge, a second edge, a third edge and a fourth edge, the first edge and the second edge being diagonally opposed to one another and defining a first distance relative to a center line between one another, and the third edge and the fourth edge being diagonally opposed to one another and defining a second distance relative to the center line, between one another, the first distance being smaller than the second distance.

3. The bulb socket assembly of claim 1 wherein the bulb accepting body portion further comprises a plurality of ribs forming at least one side rail alignment channel with an angular seat, at least one retention arm, at least one angular rib, and at least one axial channel, wherein the at least one angular rib directs a flange portion of a bulb base toward and into the at least one axial channel.

4. The bulb socket assembly of claim 1, further comprising at least one wire connected to the lead end of the at least one terminal so that the sealing material substantially covers the at least one wire as well as the terminal lead end, in order to seal the at least one wire to the terminal lead end.

5. The bulb socket assembly of claim 4 wherein the terminal accepting body portion further comprises an outer rim and the sealing material substantially fills the terminal accepting body portion to the outer rim.

6. The bulb socket assembly of claim 5 wherein the sealing material is comprised of polyurethane.

7. The bulb socket assembly of claim 5 wherein the sealing material is comprised of mold nylon.

8. The bulb socket assembly of claim 5 wherein the rim of the terminal accepting body portion includes at least one wire retention slot and the at least one wire is directed through the at least one wire retention slot.

9. The bulb socket assembly of claim 2 further comprises a bulb positioned in the bulb accepting body portion, the bulb having a base, wherein insertion of the bulb into the bulb accepting body portion causes the bulb base to contact the diagonally opposed first edge and second edge of the plurality of ribs and causes a slight rotation of the bulb as the bulb base is inserted into the bulb accepting body portion.

10. A method of securing wires to terminals in an automotive lamp bulb socket assembly comprising the steps of:

a. providing an automotive bulb socket having a bulb accepting body portion, a terminal accepting body portion that is integral with the bulb accepting body portion, and a terminal receiver slot that passes through both the bulb accepting body portion and the terminal accepting body portion;

b. providing at least one terminal having:

(i) a blade extending into the bulb accepting body portion, (ii) a lead end substantially perpendicular to the blade and positioned in the terminal accepting body portion, and (iii) a substantially flat cover plate substantially parallel and integral with the lead end and substantially perpendicular to and integral with the blade;

c. inserting the at least one terminal into the bulb socket so that the blade is positioned in the at least one receiver slot and extends into the bulb accepting body portion, the lead end is positioned in the terminal accepting body portion, and the cover plate covers the at least one terminal receiver slot;

d. connecting at least one wire to the lead end of the at least one terminal; and e. substantially covering the lead end and the cover plate of the at least one terminal with a sealing material positioned in the terminal accepting body portion, so that the cover plate prevents the sealing material from entering into the bulb accepting portion.

11. The method of claim 10 wherein the terminal accepting body portion further comprises an outer rim.

12. The method of claim 11 further comprising the step of substantially filling the terminal accepting body portion to the outer am with the sealing material.

13. The method of claim 12 wherein the sealing material is comprised of polyurethane.

14. The method of claim 12 wherein the sealing material is comprised of mold nylon.

15. The method of claim 12 wherein at least one wire retention slot is formed in the outer rim.

16. The method of claim 15 further comprising the step of inserting the at least one wire into the at least one wire retention slot before the step of substantially filling the terminal accepting body portion to the outer rim with sealing material.

17. A bulb socket assembly for receiving a bulb having a base comprising a cylindrical portion and a flange portion, the bulb socket assembly comprising:

a. bulb accepting body portion for receiving the bulb;

b. a terminal accepting body portion connected to the bulb accepting body portion; and c. at least two ribs inside the bulb accepting body portion that form a first edge, a second edge, a third edge and a fourth edge, the first edge and the second edge being diagonally opposed to one another and defining a first distance relative to a centerline between one another, and the third edge and the fourth edge being diagonally opposed to one another and defining a second distance relative to the centerline between one another, the first distance being smaller than the second distance, so that the first and second edges contact the base of the bulb and cause the bulb to rotate when the bulb is inserted into the bulb accepting portion.

18. The bulb socket assembly of claim 17, further comprising a first bulb flange channel and a second bulb flange channel located on opposite sides of the plurality of ribs in the bulb accepting body portion, the first and second bulb flange channels designed and dimensioned to receive the flange portion of the bulb's base, when the bulb is inserted into the bulb accepting body.

19. The bulb socket assembly of claim 18, further comprising a first terminal and a second terminal, each terminal having a blade extending into the bulb accepting portion, a lead end positioned in the terminal accepting body portion, and a cover plate that is integral with both the lead end and the blade.

20. The bulb socket assembly of claim 19, wherein the blade of the first terminal and the blade of the second terminal, each comprise two prongs.

21. The bulb socket assembly of claim 20, wherein the blade of the first terminal extends into the first flange channel and the blade of the second terminal extends into the second first flange channel, so that the flange portions of the bulb are placed in between the two prongs after the bulb is inserted.

22. A right-angle, one-piece, snap-in terminal for insertion into an automotive lamp bulb socket having a receiver slot passing through a first portion and a second portion of the bulb socket, the first portion of the bulb socket designed to receive a sealing material that seals the terminal to at least one wire connected to the terminal, wherein the terminal comprises:

a. a substantially flat cover plate designed and dimensioned to substantially cover the receiver slot of the bulb socket and to prevent the sealing material from passing from the first portion of the bulb socket to the second portion of the bulb socket;

b. a blade extending from and integral with the cover plate so that the blade is substantially perpendicular to the cover plate; and c. a lead end extending from and integral with the cover plate so that the lead end is substantially parallel to the cover plate and substantially perpendicular to the blade.

23. The right-angle, one-piece terminal of claim 22, wherein the terminal further comprises a terminal connecting piece that extends from and is integral with the cover plate so that the terminal connecting piece is substantially perpendicular to the cover plate.

24. The right-angle, one-piece terminal of claim 23, wherein the terminal connecting piece comprises a latch.

25. The right-angle, one-piece terminal of claim 22, wherein the blade comprises two prongs for electrically connecting the terminal to a bulb socket.

26. The right-angle, one-piece terminal of claim 22, wherein the lead end comprises a wire cradle and a wire connecting piece.

27. A method of inserting a right-angle, one-piece terminal into an automotive lamp bulb socket assembly, wherein the method comprises the steps of:

a. providing at least one right-angle, one-piece terminal having (i) a substantially flat cover plate, (ii) a blade extending from and integral with the cover plate so that the blade is substantially perpendicular to the cover plate, and (iii) a lead end extending from and integral with the cover plate so that the lead end is substantially parallel to the cover plate and substantially perpendicular to the blade, b. providing a socket assembly with at least one receiver slot, wherein each of the at least one receiver slots is designed and dimensioned to receive each of the at least one terminals;

c. inserting the at least one terminal into the at least one receiver slot so that the blade is inserted into the receiver slot and the cover plate substantially covers the receiver slot; and d. substantially covering the lead end and the cover plate with a sealing material to seal the lamp socket and to use the cover plate to prevent the sealing material from entering the receiver slot.

* * * * *

UNITED STATES PATENT AND TRADEMARK OFFICE

CERTIFICATE OF CORRECTION

PATENT NO. : 7,014,510 B2
APPLICATION NO. : 10/264221
DATED : March 21, 2006
INVENTOR(S) : Christopher R. Powers et al.

It is certified that error appears in the above-identified patent and that said Letters Patent is hereby corrected as shown below:

Cover Page

Item (74), "Miiler" should be replaced with -- Miller --;

Column 12, Claim 1

Line 33, "mud" should be replaced with -- and --;

Column 13, Claim 9

Line 3, "comprises" should be replaced with -- comprising --;

Column 13, Claim 12

Line 44, "am" should be replaced with -- rim--;

Column 13, Claim 17

Line 59, "bulb accepting" should be replaced with -- a bulb accepting --;

Column 14, Claim 21

Line 24, "second first flange" should be replaced with -- second bulb flange --; and Column 14, Claim 21

Line 24 "portions" should be replaced with -- portion --.

Signed and Sealed this

Twenty-fourth Day of April, 2007

JON W. DUDAS
*Director of the United States Patent and Trademark Office*